US011586125B2

(12) United States Patent
Yamagishi

(10) Patent No.: US 11,586,125 B2
(45) Date of Patent: Feb. 21, 2023

(54) IMAGE FORMING APPARATUS CAPABLE OF DETERMINING WHETHER A CONTAINER IS NEW OR USED

(71) Applicant: KYOCERA Document Solutions Inc., Osaka (JP)

(72) Inventor: Rei Yamagishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/649,315

(22) Filed: Jan. 28, 2022

(65) Prior Publication Data

US 2022/0252999 A1 Aug. 11, 2022

(30) Foreign Application Priority Data

Feb. 5, 2021 (JP) ..... JP2021-017003

(51) Int. Cl.
*G03G 15/00* (2006.01)
*G03G 15/08* (2006.01)
(Continued)

(52) U.S. Cl.
CPC ..... *G03G 15/0863* (2013.01); *G03G 15/55* (2013.01); *G03G 21/1676* (2013.01);
(Continued)

(58) Field of Classification Search
CPC ..... G03G 15/0863; G03G 21/1647; G03G 21/1676; G03G 21/1842; G03G 21/1853;
(Continued)

(56) References Cited

U.S. PATENT DOCUMENTS

2007/0031158 A1 2/2007 Kamimura
2007/0122165 A1* 5/2007 Igarashi ..... G03G 21/1676 399/13

(Continued)

FOREIGN PATENT DOCUMENTS

EP 1696283 A1 8/2006
EP 2937739 A1 10/2015
JP 2012237849 A 12/2012

OTHER PUBLICATIONS

European Patent Office, Extended European Search Report Issued in Application No. 22154447.1, dated Jun. 20, 2022, Germany, 7 pages.

*Primary Examiner* — Sophia S Chen
(74) *Attorney, Agent, or Firm* — Alleman Hall Creasman & Tuttle LLP

(57) ABSTRACT

An image forming apparatus includes a container that can store developer; an apparatus body by which the container is detachably supported; a detection portion, for determining an installed state of the container, provided for the apparatus body; and a control portion determining whether the container is unused based on a detection result by the detection portion. The container includes a displaceable member displaced between an initial position where the displaceable member is not detected by the detection portion and a detection position where the displaceable member is detected by the detection portion. When the container is in an initial installation state immediately after being installed in the apparatus body, the control portion determines the container is unused in a case where the displaceable member is not detected by the detection portion, and determines the container is used in a case where the displaceable member is detected by the detection portion.

5 Claims, 25 Drawing Sheets

(51) Int. Cl.
*G03G 21/18* (2006.01)
*G03G 21/16* (2006.01)

(52) U.S. Cl.
CPC ..... *G03G 21/1842* (2013.01); *G03G 21/1857* (2013.01); *G03G 21/1896* (2013.01)

(58) Field of Classification Search
CPC . G03G 21/1857; G03G 21/1896; G03G 15/55
See application file for complete search history.

(56) References Cited

U.S. PATENT DOCUMENTS

2018/0032016 A1* 2/2018 Kamimura ..... G03G 21/1647
2021/0397121 A1* 12/2021 Uohashi ..... G03G 21/1676

* cited by examiner

IMAGE FORMING APPARATUS CAPABLE OF DETERMINING WHETHER A CONTAINER IS NEW OR USED

INCORPORATION BY REFERENCE

This application is based upon and claims the benefit of priority from the corresponding Japanese Patent Application No. 2021-017003 filed on Feb. 5, 2021, the entire contents of which are incorporated herein by reference.

BACKGROUND

The present disclosure relates to image forming apparatuses including copiers and multifunction peripherals.

An electrophotographic image forming apparatus includes a developing device that develops electrostatic latent images on a photoconductor drum using toner. The developing device includes a developing roller rotatably supported inside the housing of the developing device and supplies toner stored inside the housing from the developing roller to the photoconductor drum to perform development.

The image forming apparatus further includes a toner container that stores toner to be supplied to the developing device. When the toner inside the toner container is completely consumed, the toner container is replaced with a new toner container filled with toner.

The developing roller of the developing device deteriorates over time and causes development failure. To maintain image quality, the developing device is replaced with a new developing device after a predetermined period of time. In addition, in a case where the developing device includes a toner storing portion integral thereto, the developing device cannot perform development when the toner inside the toner storing portion runs out. Accordingly, the developing device is replaced with a new, unused developing device filled with toner. For these reasons, a typical image forming apparatus is configured to support a developing device such that the developing device is detachable and replaceable.

SUMMARY

An image forming apparatus according to an aspect of the present disclosure includes a container that can store developer inside the container; an apparatus body by which the container is detachably supported; a detection portion, for determining an installed state of the container, provided for the apparatus body; and a control portion configured to determine whether or not the container is an unused container based on a result of detection by the detection portion. The container includes a displaceable member that can be displaced between an initial position at which the displaceable member is not detected by the detection portion and a detection position at which the displaceable member is detected by the detection portion. When the container is in an initial installation state immediately after the container is installed in the apparatus body, the control portion determines that the container is an unused container in a case where the displaceable member is not detected by the detection portion, and determines that the container is a used container in a case where the displaceable member is detected by the detection portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
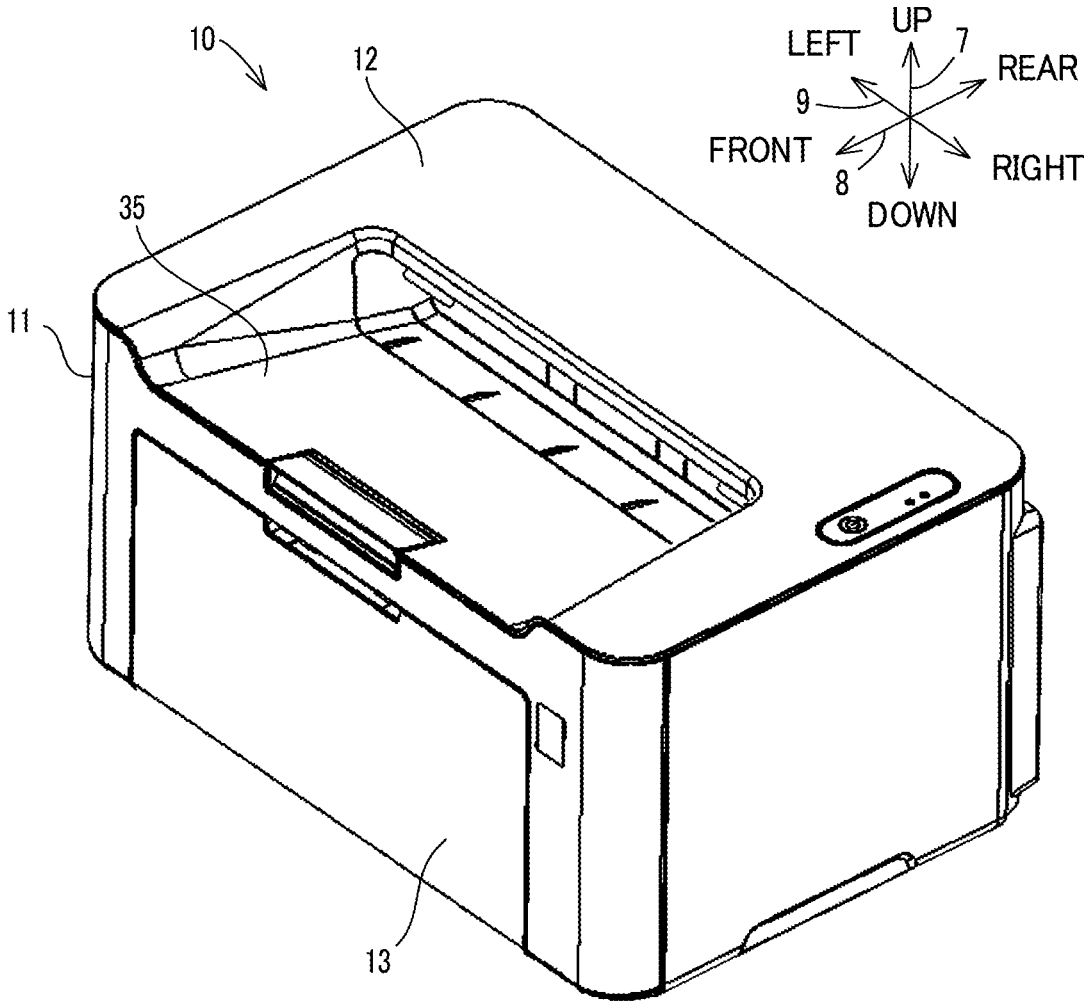
FIG. 1 is a perspective view of an image forming apparatus according to an embodiment of the present disclosure.

The following describes embodiments of the present disclosure with reference to the accompanying drawings. It should be noted that the following embodiments are examples of specific embodiments of the present disclosure and should not limit the technical scope of the present disclosure. In the description below, an up-down direction 7, a front-rear direction 8, and a left-right direction 9 in the drawings are used for purposes of illustration. In FIGS. 1 to 5, the vertical direction in a state where an image forming apparatus 10 is installed and ready for use (state shown in FIG. 1) is defined as the up-down direction 7, and the front-rear direction 8 and the left-right direction 9 (width direction 9) are defined relative to the installed state.

Figure 2:
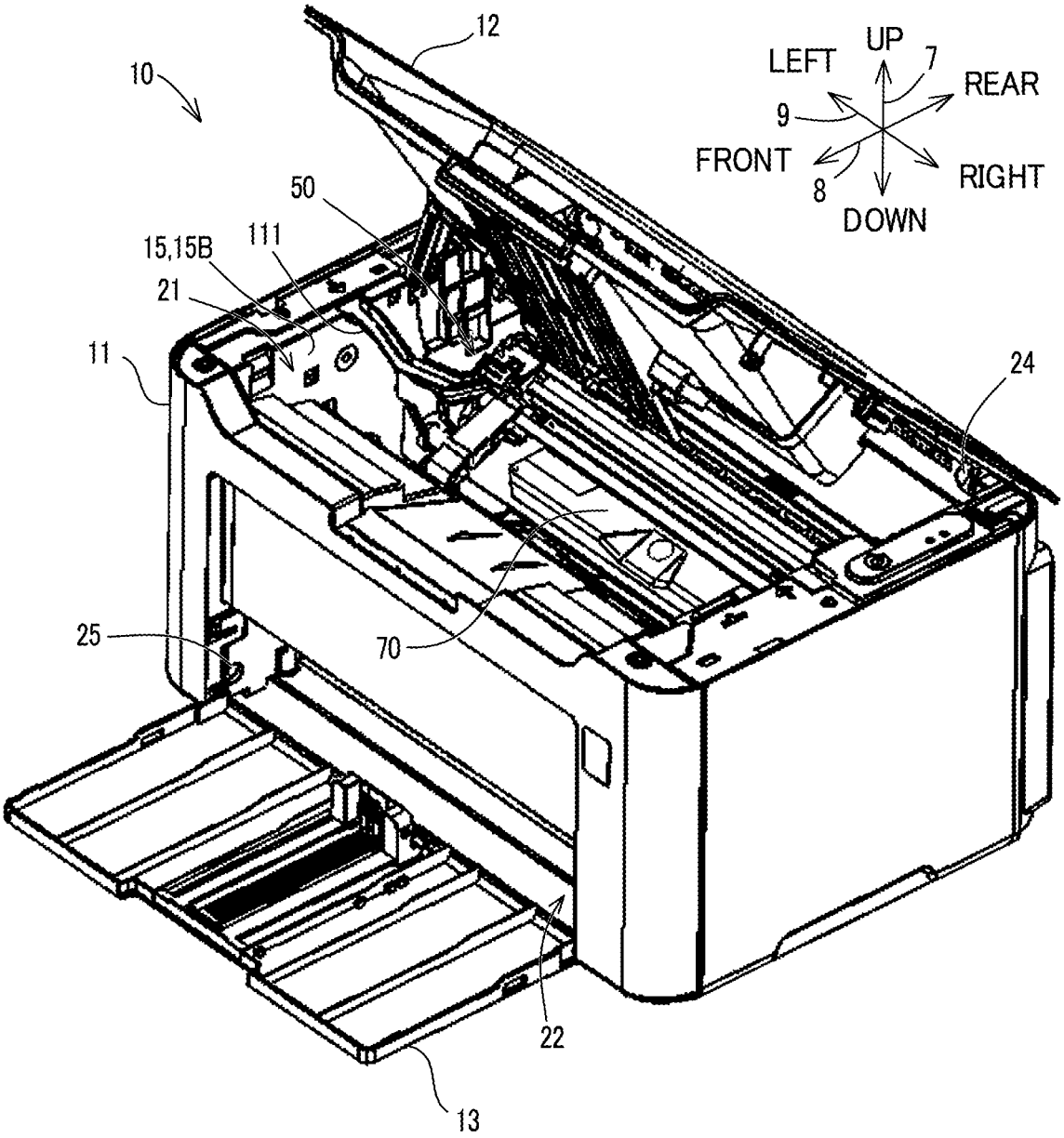
FIG. 2 is a perspective view of the image forming apparatus according to the embodiment of the present disclosure with its top cover open.
Figure 3:
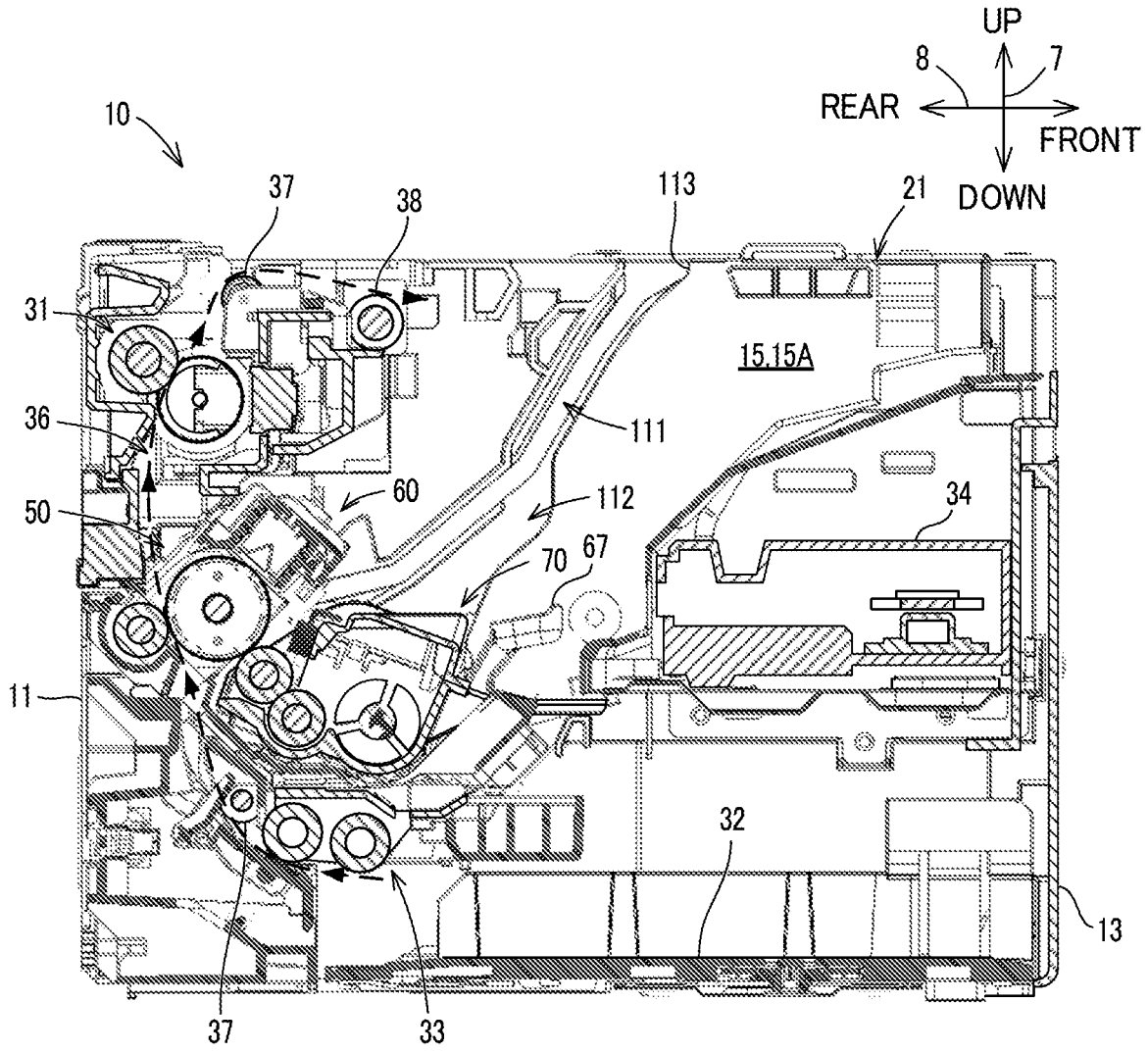
FIG. 3 is a cross-sectional view showing the configuration inside the image forming apparatus according to the embodiment of the present disclosure.

FIGS. 1 to 3 show the image forming apparatus 10 according to an embodiment of the present disclosure. The image forming apparatus 10 is provided with at least a print function and is, for example, a printer that forms monochrome images on sheets such as printing sheets by an electrophotographic method. The image forming apparatus 10 prints images on printing sheets on the basis of image data input from the outside through a communication portion (not shown). It is noted that the image forming apparatus 10 is not limited to a monochrome printer but may be a color printer that forms color images. In addition, the image forming apparatus 10 may be a multifunction peripheral such as a facsimile or a copier having other functions in addition to the print function.

FIGS. 1 and 2 are perspective views showing the external appearance of the image forming apparatus 10. In FIG. 1, a top cover 12 and a front cover 13 are closed, whereas the top cover 12 and the front cover 13 are open in FIG. 2. FIG. 3 is a cross-sectional view showing the configuration inside an apparatus body 11. It is noted that the top cover 12 is not shown in FIG. 3.

As shown in FIGS. 1 and 2, the image forming apparatus 10 has a substantially rectangular parallelepiped shape elongated in the width direction 9. The image forming apparatus 10 includes the apparatus body 11 in which various components that perform an image formation process are installed, the top cover 12 disposed in an upper part of the apparatus body 11, and the front cover 13 disposed on the front face of the apparatus body 11.

As shown in FIG. 2, the apparatus body 11 has an opening 21 in the upper part. The opening 21 communicates with the inside and can be opened and closed by the top cover 12. The top cover 12 is supported by a hinge 24 disposed at the rear end in the upper part of the apparatus body 11 and opens and closes the opening 21 by changing its position between an open position (position shown in FIG. 2) in which the opening 21 is opened and a closed position (position shown in FIG. 1) in which the opening 21 is closed. When the top cover 12 pivots upward (opening direction) to open the opening 21, an image forming unit 50 (described later) and the like installed in the apparatus body 11 are exposed. In this state, users can take out a developing device 70 supported by the image forming unit 50 from inside the apparatus body 11.

In addition, the apparatus body 11 has an opening 22 in a lower part of the front face. The opening 22 communicates with the inside and can be opened and closed by the front cover 13. The front cover 13 is supported by a hinge 25 disposed at the lower end in the front of the apparatus body 11 and opens and closes the opening 22 by changing its position between an open position (position shown in FIG. 2) in which the opening 22 is opened and a closed position (position shown in FIG. 1) in which the opening 22 is closed. When the front cover 13 pivots forward (opening direction) to open the opening 22, printing sheets can be set inside the apparatus body 11 through the opening 22.

As shown in FIG. 3, the image forming apparatus 10 mainly includes the image forming unit 50, a fixing portion 31, a paper feed tray 32, a conveying unit 33 an LSU (Laser Scanner Unit) 34, a sheet discharge tray 35 (see FIG. 1), a plurality of conveying rollers 37 disposed on a conveyance path 36, and a discharge roller 38 disposed at the trailing end of the conveyance path 36. The components are installed inside the apparatus body 11 including outer frame covers and inner frames of the image forming apparatus 10. It is noted that the conveyance path 36 is indicated by broken lines extending upward from the conveying unit 33 in FIG. 3.

Figure 4:
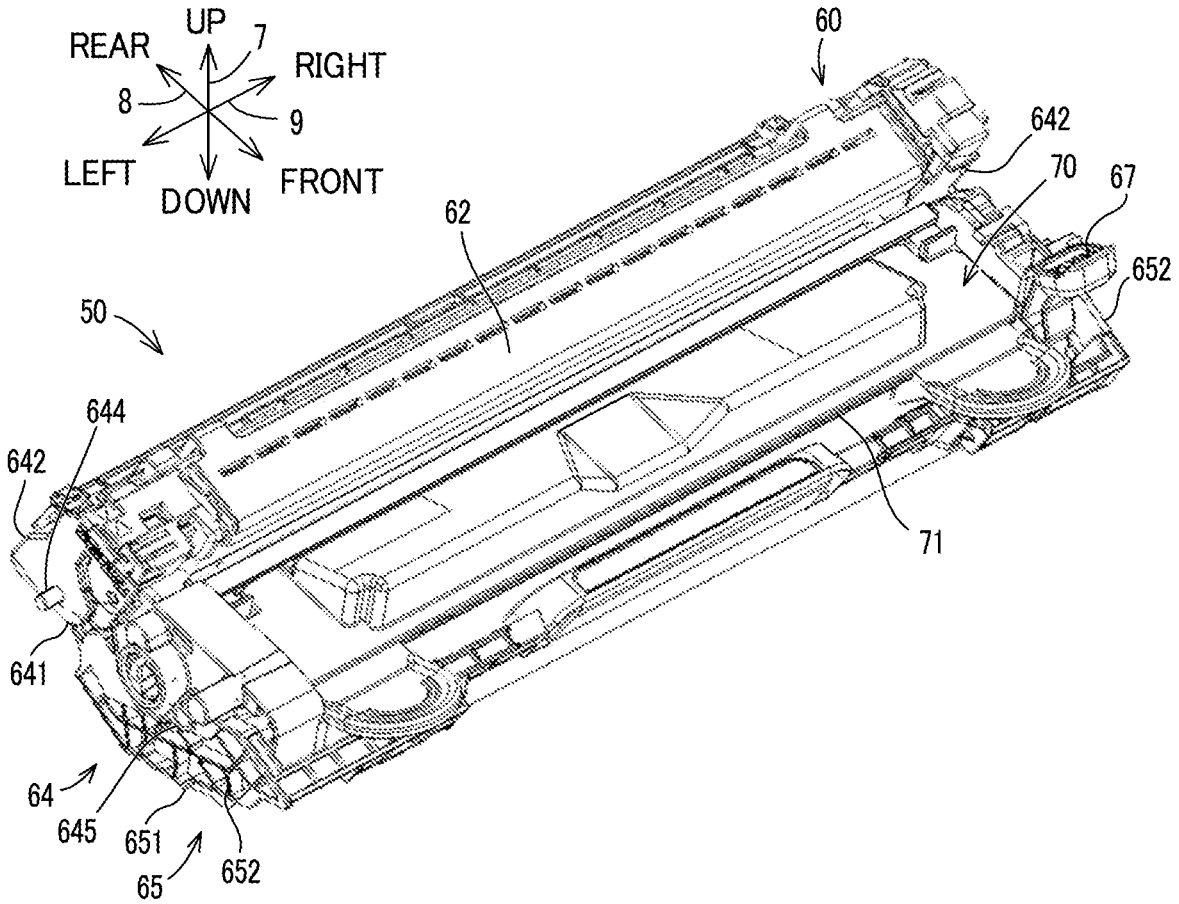
FIG. 4 is a perspective view of an image forming unit provided for the image forming apparatus according to the embodiment of the present disclosure.

FIG. 4 is a perspective view of the image forming unit 50. The image forming unit 50 is configured to form images by an electrophotographic method and includes a drum unit 60 and the developing device 70. In the present embodiment, the image forming unit 50 is detachably supported by the apparatus body 11 so as to be replaceable.

Figure 5:
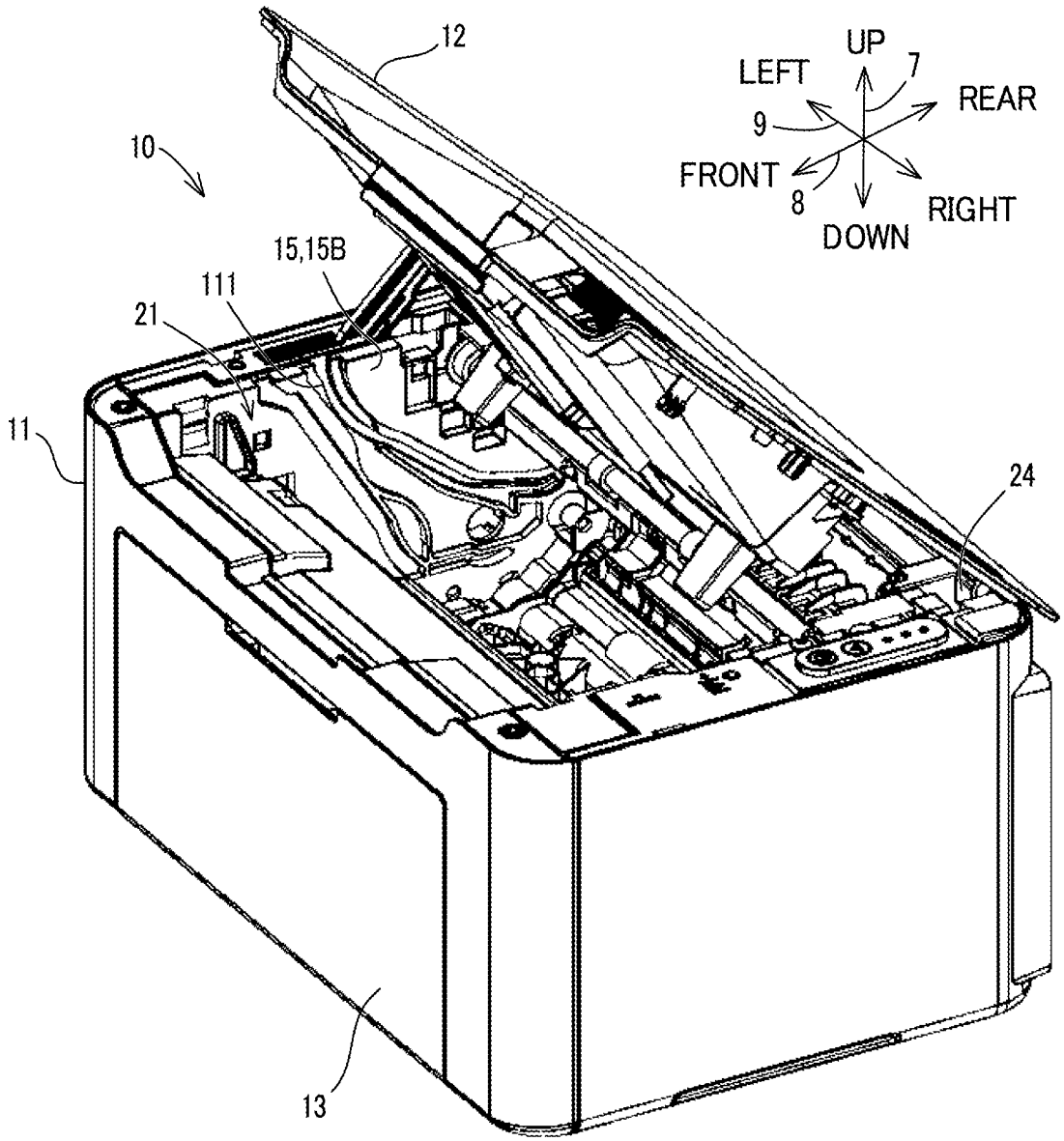
FIG. 5 is a perspective view of the image forming apparatus according to the embodiment of the present disclosure when the image forming unit is removed from an apparatus body.

When developer stored in the developing device 70 runs out, the developing device 70 needs to be replaced with another developing device 70 filled with developer. To achieve this, in the present embodiment, the developing device 70 is supported by the apparatus body 11 to be detachable from the apparatus body 11. Specifically, the developing device 70 is installed to be detachable from the drum unit 60 (an example of an installation member) installed in the apparatus body 11. It is noted that the developing device 70 is also removed for the maintenance of the inside of the image forming apparatus 10 when necessary. FIGS. 2 and 3 show the apparatus body 11 with the image forming unit 50 installed therein. FIG. 5 shows the apparatus body 11 from which the image forming unit 50 is removed.

Figure 6:
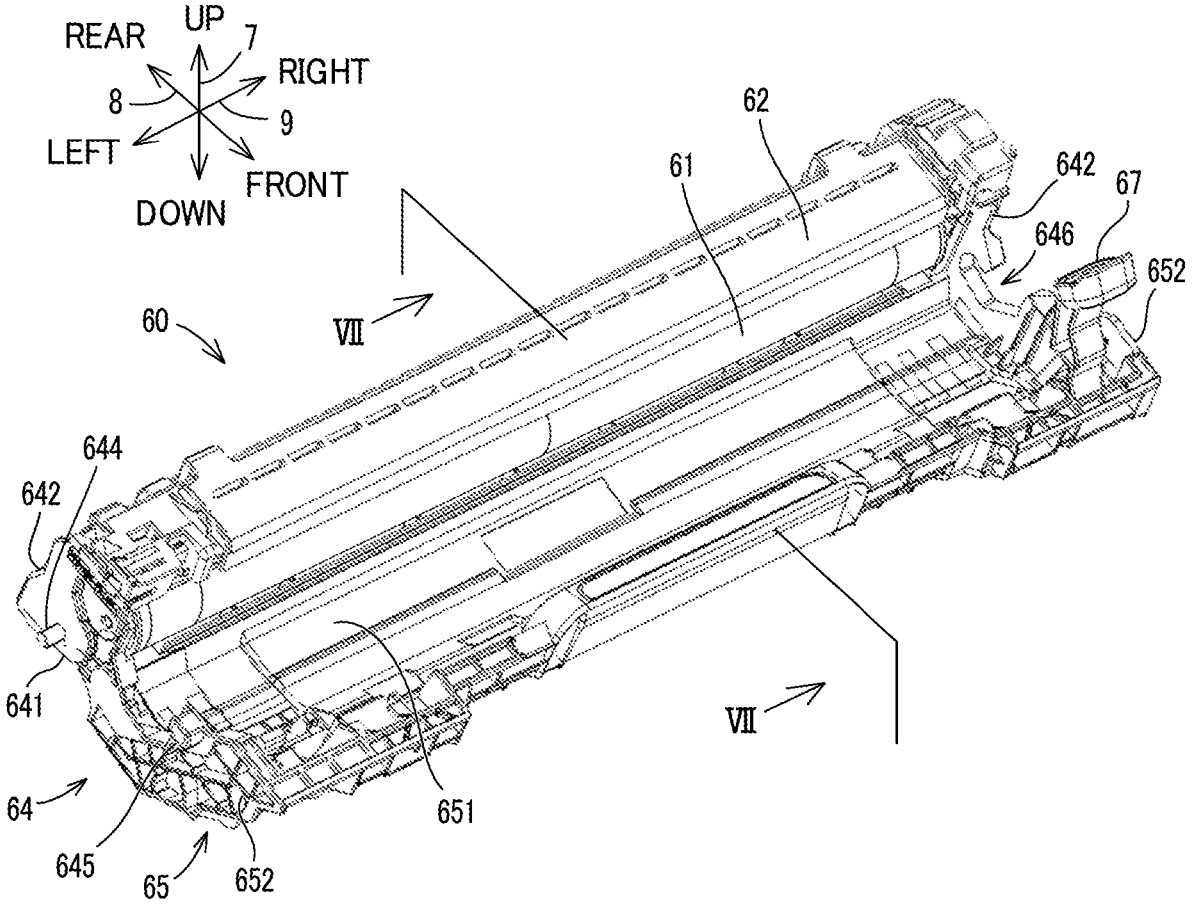
FIG. 6 is a perspective view of a drum unit provided for the image forming apparatus according to the embodiment of the present disclosure.
Figure 7:
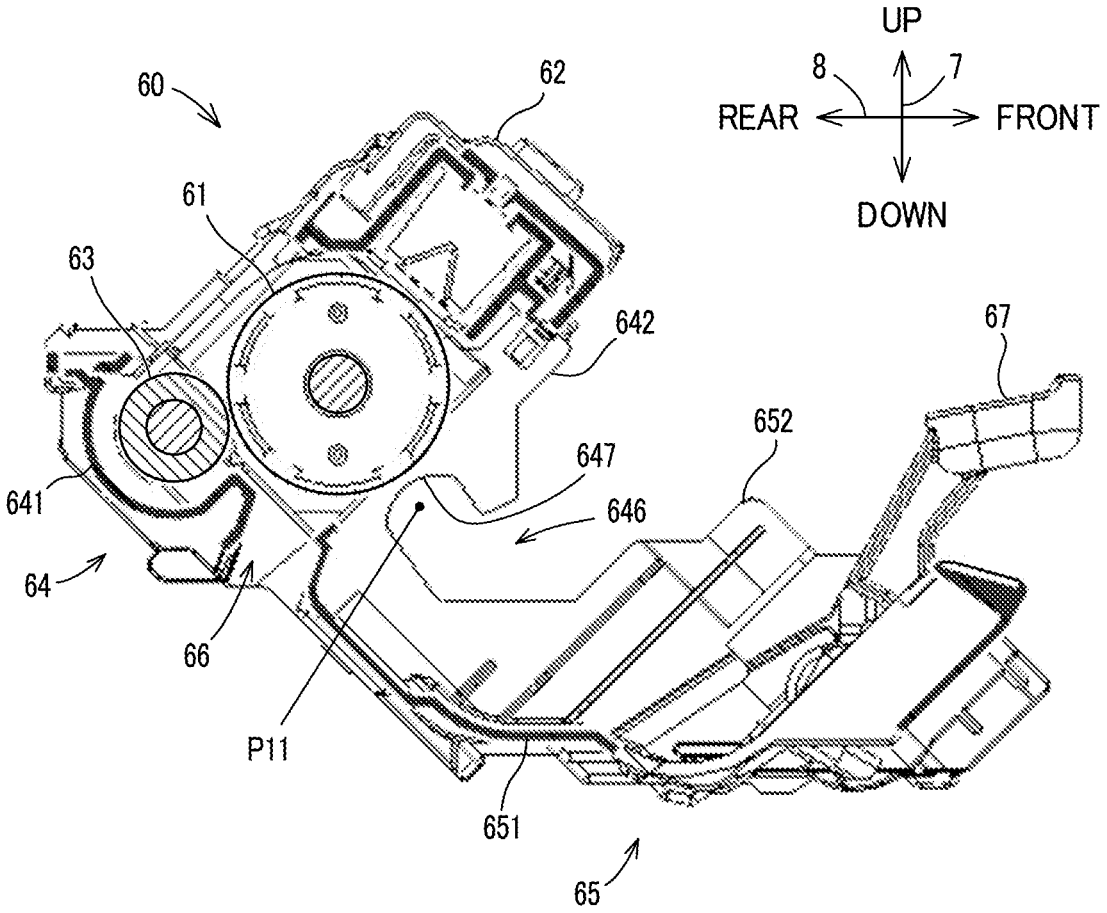
FIG. 7 is a cross-sectional view, taken along cutting plane VII-VII in FIG. 6, showing the configuration of the drum unit provided for the image forming apparatus according to the embodiment of the present disclosure in cross-section.

FIG. 6 is a perspective view of the drum unit 60. FIG. 7 is a cross-sectional view, taken along line VII-VII in FIG. 6, showing the configuration of the drum unit 60 in cross-section.

As shown in FIGS. 6 and 7, the drum unit 60 includes a photoconductor drum 61, a charging portion 62, a transfer roller 63, and a housing 64. The housing 64 supports the photoconductor drum 61, the charging portion 62, and the transfer roller 63. In addition, the developing device 70 is detachably supported by a developing-device support portion 65 integral to the housing 64.

The housing 64 is a molded part formed from, for example, synthetic resin and includes a first base frame 641 extending in the left-right direction 9 and a pair of support frames 642 each extending straight upward from left or right end of the first base frame 641. The support frames 642 have, for example, a thin, flat shape. The support frames 642 are composed of an insulating member that does not conduct electricity. The support frames 642 extend in the front-rear direction 8. The photoconductor drum 61 and the transfer roller 63 are rotatably supported in rear parts of the support frames 642 while being in pressure contact with each other. In addition, the charging portion 62 is attached to upper rear parts of the support frames 642. The charging portion 62 is attached to the support frames 642 to connect the support frames 642 while facing the outer peripheral surface of the photoconductor drum 61.

As shown in FIGS. 6 and 7, the developing-device support portion 65 is integral to a front part of the housing 64. The developing-device support portion 65 includes a second base frame 651 extending forward from the first base frame 641 with a paper feed slot 66 (see FIG. 7) therebetween and front plates 652 constituting front parts of the support frames 642. When the developing device 70 is installed in the developing-device support portion 65, the lower surface 716 (see FIG. 12) of the developing device 70 is supported by the second base frame 651. In this case, the lower surface 716 serves as a surface to be supported by the drum unit 60.

The paper feed slot 66 is a through-hole formed between the first base frame 641 and the second base frame 651 and guides a printing sheet fed from the paper feed tray 32 therethrough to a transfer position between the photoconductor drum 61 and the transfer roller 63.

When an image forming operation starts, in the image forming unit 50 installed in the apparatus body 11, the charging portion 62 uniformly charges a photosensitive layer on the surface of the photoconductor drum 61 to a predetermined potential. Then, the LSU 34 scans a laser beam based on image data over the photoconductor drum 61. This forms an electrostatic latent image on the surface of the photoconductor drum 61. Bias voltages are applied to the photoconductor drum 61 and a developing roller 74 (see FIG. 10) of the developing device 70 to create an electric field having a predetermined potential difference between the photoconductor drum 61 and the developing roller 74. This enables toner to move from the developing roller 74 to the photoconductor drum 61. The potential difference causes the toner on the developing roller 74 to adhere to the electrostatic latent image and thus forms a toner image on the photoconductor drum 61. An electric field having a predetermined potential difference is also created between the photoconductor drum 61 and the transfer roller 63. The potential difference causes the toner image on the photoconductor drum 61 to be transferred to a printing sheet fed from the paper feed tray 32. The printing sheet to which the toner image is transferred is conveyed to the fixing portion 31.

The fixing portion 31 is disposed downstream of the image forming unit 50 in a conveying direction of the printing sheet. The fixing portion 31 fixes the toner image transferred to the printing sheet onto the printing sheet by heat. The fixing portion 31 includes a heating roller and a pressure roller. The heating roller is heated by heating means such as an induction heater during a fixing operation. The pressure roller is biased to the heating roller by an elastic member. When the printing sheet passes through the fixing portion 31, toner is heated and fused onto the printing sheet while the printing sheet is pressed by the fixing portion 31. Thus, the toner image is fixed onto the printing sheet, and an image is formed on the printing sheet.

The discharge roller 38 is disposed downstream of the fixing portion 31 in the conveying direction. The discharge roller 38 discharges the printing sheet onto which the image is fixed by the fixing portion 31, that is, after image formation, to the sheet discharge tray 35 (see FIG. 1).

Figure 8:
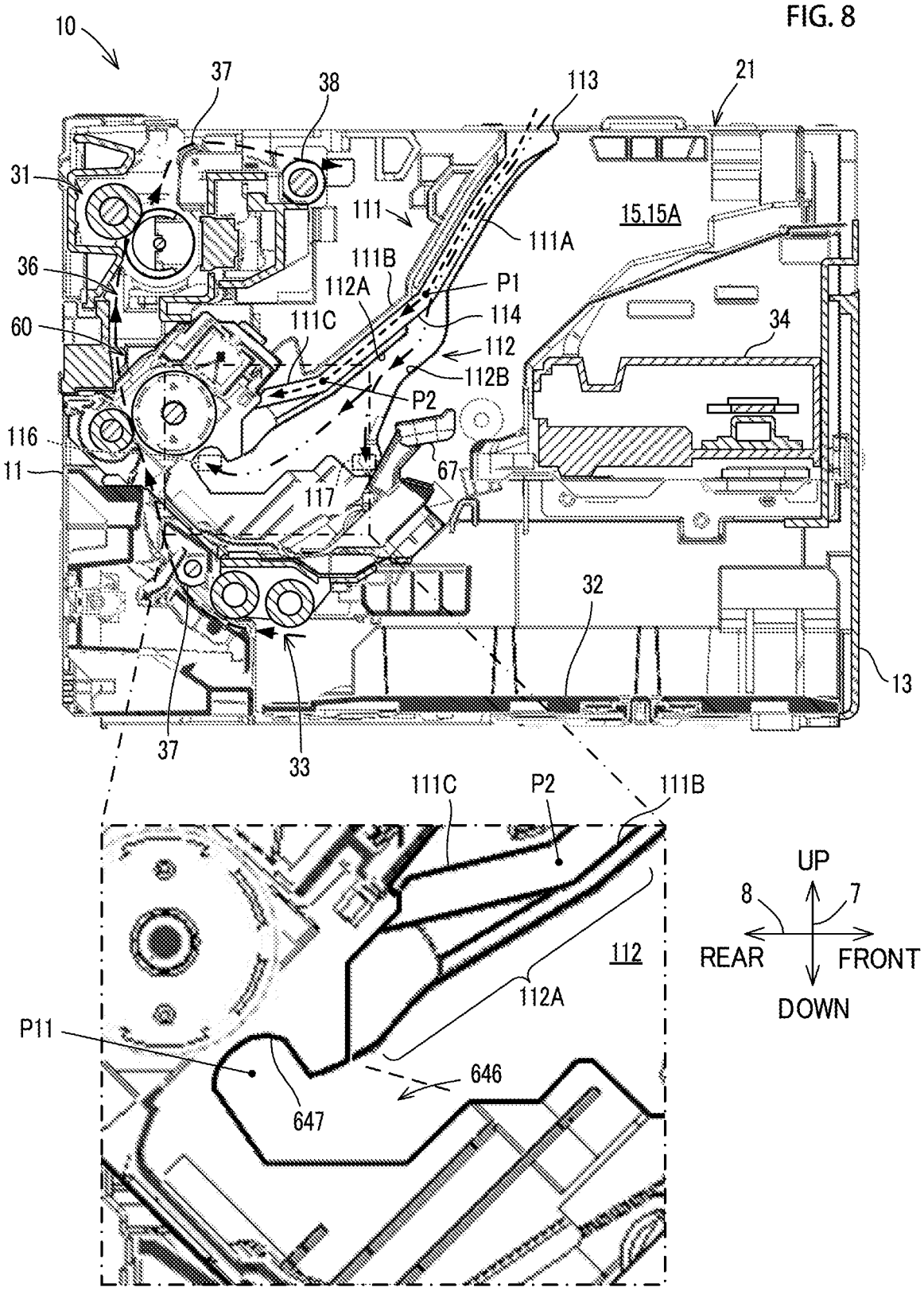
FIG. 8 is a cross-sectional view showing the configuration inside the image forming apparatus according to the embodiment of the present disclosure when the drum unit is installed in the apparatus body.

As more images are formed, the photosensitive layer on the surface of the photoconductor drum 61 of the drum unit 60 deteriorates and wears. Deterioration of the photosensitive layer prevents the photosensitive layer from being charged properly, and wear on the photosensitive layer prevents the photosensitive layer from being charged to a predetermined potential. As a result, the image quality degrades. Accordingly, the photoconductor drum 61 needs to be replaced at a predetermined timing of replacement. To achieve this, in the present embodiment, the drum unit 60 is supported by the apparatus body 11 to be detachable from the apparatus body 11 so that the photoconductor drum 61 can be replaced. In addition, the drum unit 60 is also removed for the maintenance of the inside of the image forming apparatus 10 when necessary. Here, FIG. 8 is a cross-sectional view showing a state where only the drum unit 60 of the image forming unit 50 is installed in the apparatus body 11. That is, the developing device 70 is not shown in FIG. 8.

As shown in FIG. 8, the apparatus body 11 has guide grooves 111 formed in inner surfaces 15 on both sides in the left-right direction 9. The guide grooves 111 guide the drum unit 60 when the drum unit 60 is installed into the apparatus body 11 through the opening 21. The guide grooves 111 also facilitate removal of the drum unit 60 from the apparatus body 11 by guiding the drum unit 60 to the opening 21. The guide grooves 111 extend obliquely downward and rearward from insertion openings 113 having a funnel shape when viewed in cross-section and formed in upper edge parts of the inner surfaces 15. It is noted that FIG. 8 shows only the guide groove 111 formed in the inner surface 15A on the right side. However, the guide groove 111 having a similar shape is also formed in the inner surface 15B (see FIG. 5) on the left side.

The inclination of the guide grooves 111 gradually decreases toward the installation position of the drum unit 60 (position shown in FIG. 8; hereinafter referred to as "unit installation position"). Specifically, the guide grooves 111 each include a first groove 111A extending substantially straight from the insertion opening 113 to a first inflection point P1, a second groove 111B extending from the first inflection point P1 to a second inflection point P2 at an inclination less than that of the first groove 111A, and a third groove 111C extending from the second inflection point P2 to the unit installation position at an inclination less than that of the second groove 111B.

As shown in FIG. 6, the drum unit 60 is provided with guide members 644 to be inserted into the guide grooves 111 when the drum unit 60 is installed in and removed from the apparatus body 11. The guide members 644 extend straight outward from the respective outer surfaces of the pair of support frames 642 constituting the housing 64. The guide members 644 have a boss shape or a pin shape extending perpendicular to the outer surfaces of the support frames 642.

The guide members 644 are disposed in rear parts on the outer surfaces of the support frames 642. The drum unit 60 is inserted until the guide members 644 are disposed at the ends of the guide grooves 111.

As shown in FIG. 8, another guide groove 112 branches off from the guide groove 111 in the inner surface 15A. FIG. 8 shows only the guide groove 112 formed in the inner surface 15A on the right side. However, a similar guide groove 112 is also formed in the inner surface 15B on the left side. As do the guide grooves 111, the guide grooves 112 guide the drum unit 60 to the unit installation position when the drum unit 60 is installed into the apparatus body 11 through the opening 21, and guide the drum unit 60 to the opening 21 when the drum unit 60 is removed from the apparatus body 11.

The guide grooves 112 extend obliquely downward and rearward from the first inflection points P1 in the guide grooves 111. The guide grooves 112 gradually widen obliquely rearward from upper end openings 114 serving as connection points between the guide grooves 112 and the guide grooves 111. In other words, the guide grooves 112 have a substantially divergent shape broadening obliquely rearward from the upper end openings 114.

The upper wall surfaces of the guide grooves 112 are guide surfaces 112A for guiding bearing portions 77 (described later; see FIGS. 13 and 15) provided for the developing device 70 to installation positions P11 defined on the drum unit 60 when the developing device 70 is installed in the apparatus body 11. The guide surfaces 112A are substantially parallel to the second grooves 111B of the guide grooves 111.

In addition, the lower wall surfaces of the guide grooves 112 are guide surfaces 112B for guiding guide members 645 (described later; see FIG. 6) provided for the drum unit 60 downward when the drum unit 60 is installed in the apparatus body 11. In addition, the guide surfaces 112B guide guide portions 78 and 791 (described later; see FIGS. 13 and 15) provided for the developing device 70 downward when the developing device 70 is installed in the apparatus body 11.

As shown in FIG. 6, the drum unit 60 is provided with the guide members 645 to be inserted into the guide grooves 112 when the drum unit 60 is installed in and removed from the apparatus body 11. The guide members 645 extend straight outward from the respective outer surfaces of the pair of support frames 642 constituting the housing 64. The guide members 645 have a boss shape or a pin shape extending perpendicular to the outer surfaces of the support frames 642.

The guide members 645 are disposed on the outer surfaces of the support frames 642 to be closer to the front than the guide members 644. When the drum unit 60 is installed in the apparatus body 11, first, the guide members 644 are inserted into the guide grooves 111 from the insertion openings 113. Subsequently, the guide member 645 are inserted into the guide grooves 111. During the installation of the drum unit 60, the guide members 644 are guided from the first grooves 111A to the unit installation position (position shown in FIG. 8) through the second grooves 111B along the third grooves 111C. On the other hand, during the installation of the drum unit 60, the guide member 645 enter the guide grooves 112 from the upper end openings 114 upon reaching the first inflection points P1 on the guide grooves 111, and are guided substantially downward along the guide surfaces 112B of the guide grooves 112.

When the drum unit 60 is inserted until it reaches the unit installation position shown in FIG. 8, a locking mechanism (not shown) locks the drum unit 60 at the unit installation position. That is, the drum unit 60 is positioned at the unit installation position. It is noted that the engagement by the locking mechanism is released by operating an unlocking member (not shown) provided for the apparatus body 11. This allows the drum unit 60 to be detached upward from the unit installation position and taken out to the outside through the opening 21.

In addition, as shown in FIG. 7, the support frames 642 each have a guide groove 646 for guiding the corresponding bearing portion 77 (see FIGS. 13 and 15) of the developing device 70 to the installation position P11 and a stopper 647 disposed at the end of the guide groove 646. The guide grooves 646 are formed in the support frames 642 to divide the support frames 642 into the rear parts and the front plate 652. When the bearing portions 77 are guided to the installation positions P11, the stoppers 647 position the bearing portions 77 at the installation positions P11. When the developing device 70 is installed in the apparatus body 11, the stoppers 647 abut on the bearing portions 77 and prevent the movement of the bearing portions 77 in a direction of insertion. Thus, the developing device 70 is positioned on the drum unit 60. In addition, the developing device 70 is locked to the drum unit 60 by the locking mechanism (not shown) provided for the drum unit 60. It is noted that the engagement by the locking mechanism is released by operating an unlocking lever 67 provided for the drum unit 60. This allows the developing device 70 to be detached upward from the apparatus body 11 and taken out to the outside through the opening 21.

Figure 9:
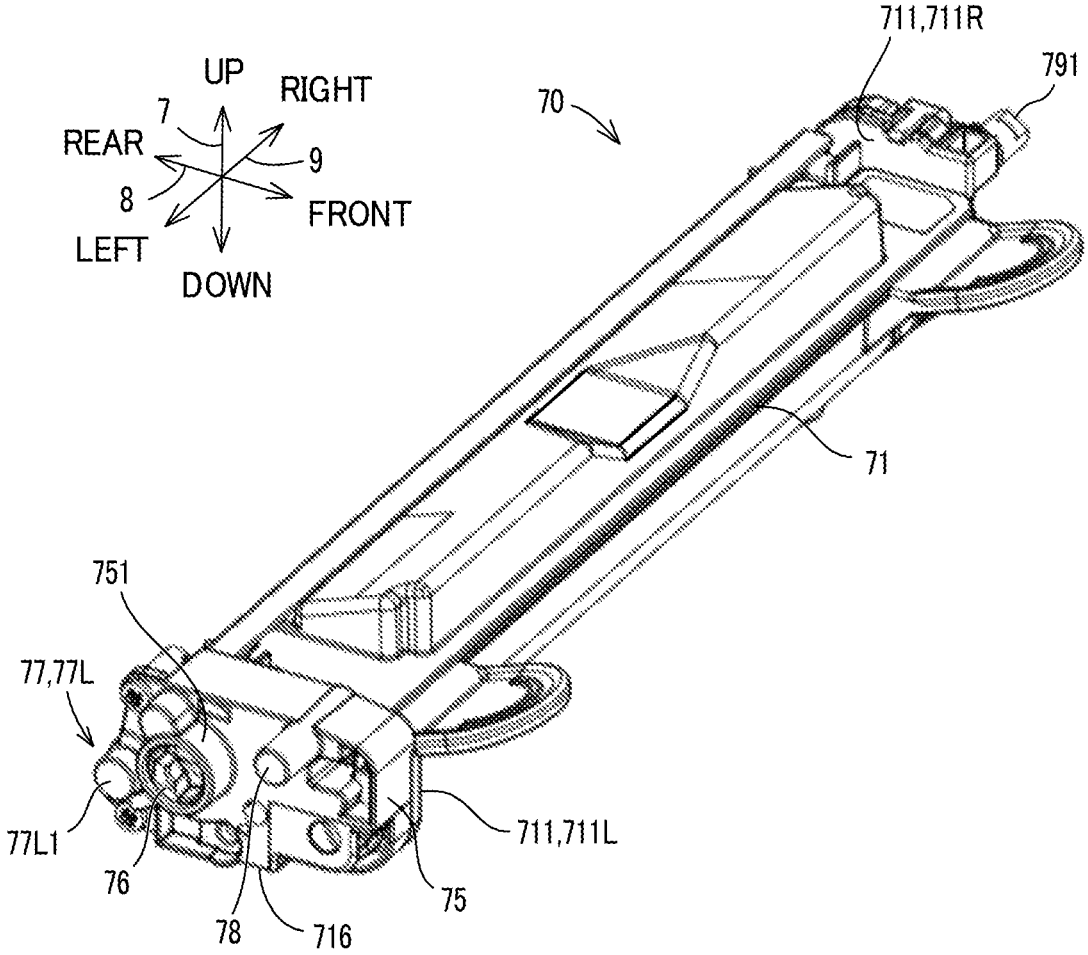
FIG. 9 is a perspective view of a developing device according to the embodiment of the present disclosure viewed from the left front.
Figure 10:
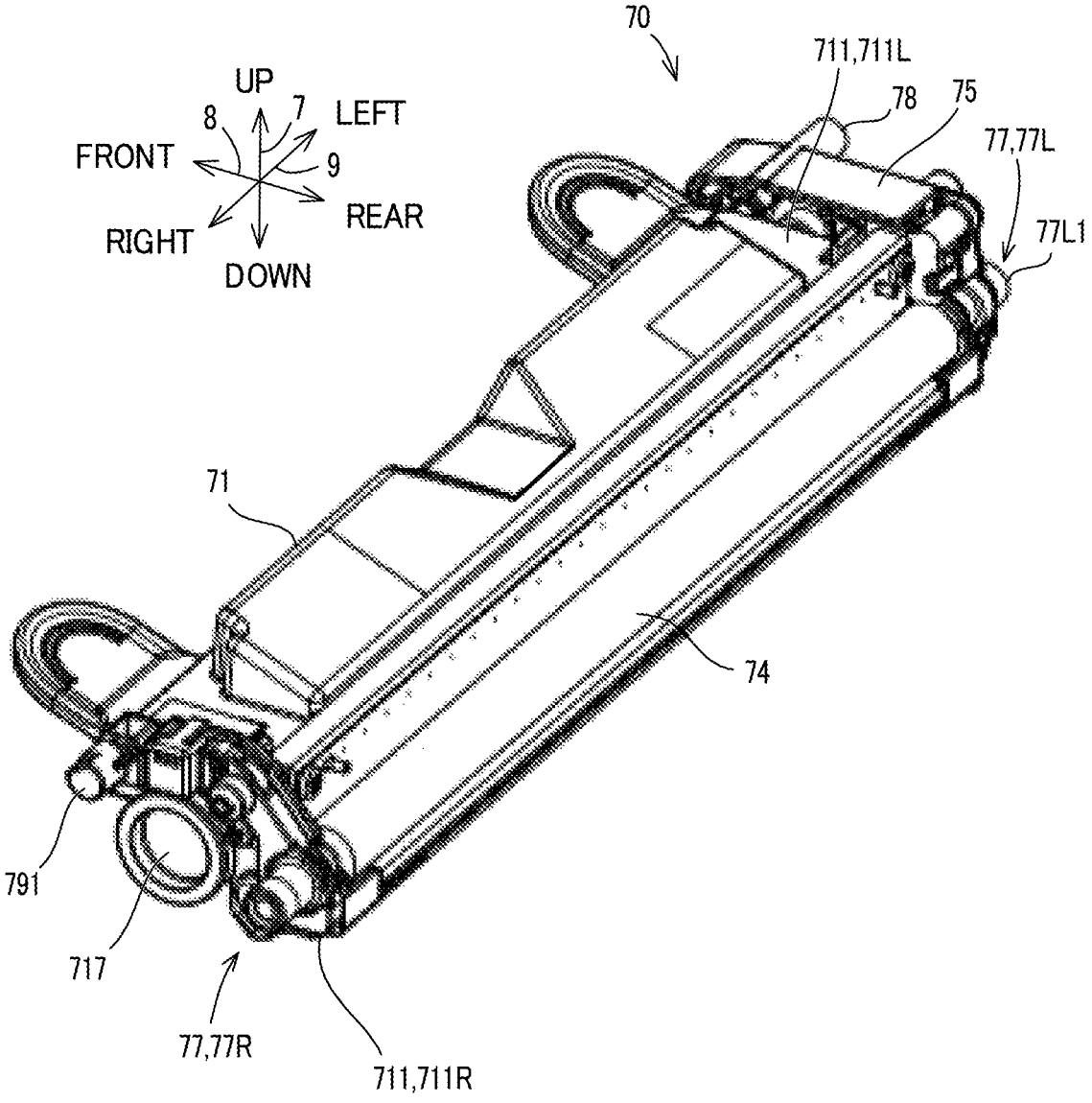
FIG. 10 is a perspective view of the developing device according to the embodiment of the present disclosure viewed from the right rear.
Figure 11:
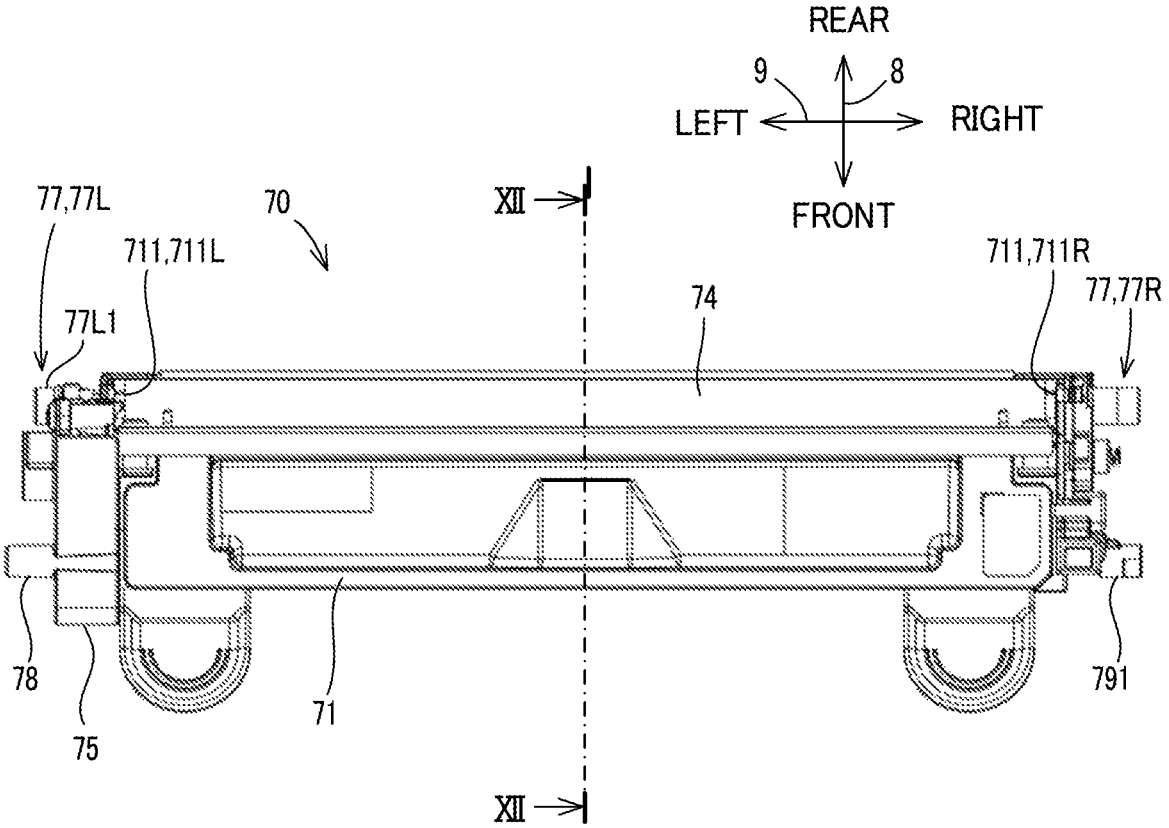
FIG. 11 is a plan view of the developing device according to the embodiment of the present disclosure.
Figure 12:
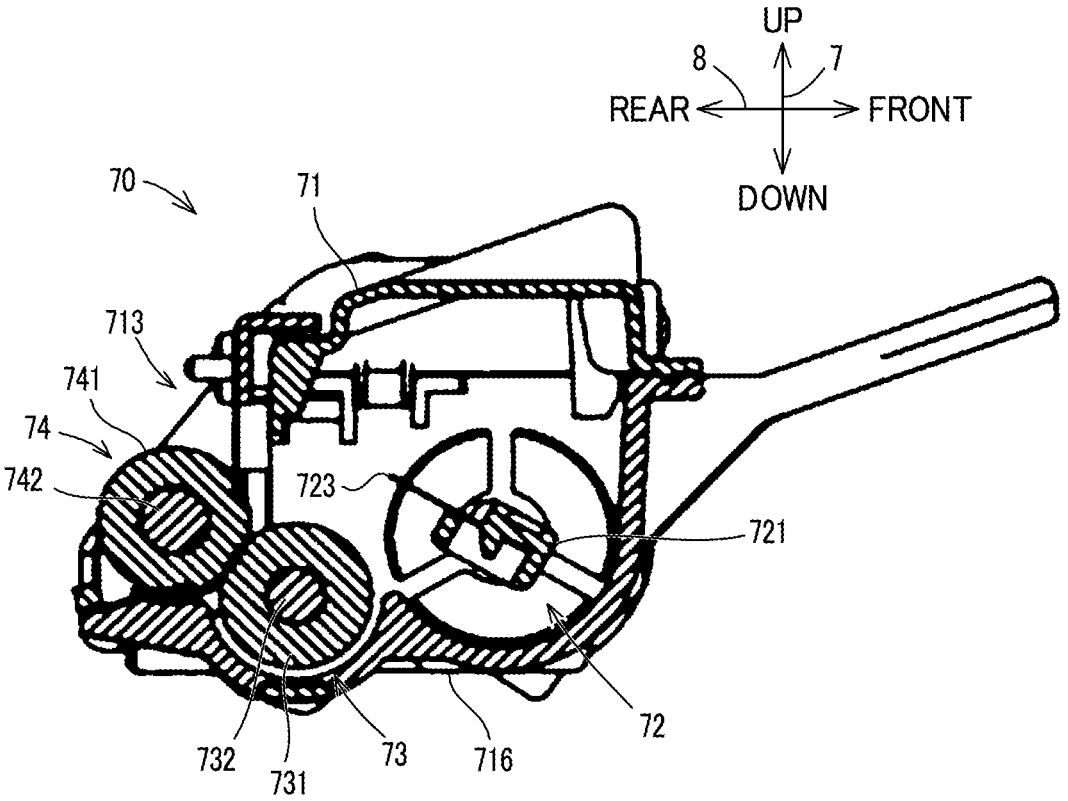
FIG. 12 is a cross-sectional view, taken along cutting plane XII-XII in FIG. 11, showing the configuration inside the developing device according to the embodiment of the present disclosure.

FIG. 9 is a perspective view of the developing device 70 viewed from the left front. FIG. 10 is a perspective view of the developing device 70 viewed from the right rear. FIG. 11 is a plan view of the developing device 70. FIG. 12 is a cross-sectional view, taken along cutting plane XII-XII in FIG. 11, showing the configuration of the middle part of the developing device 70 in cross-section.

The developing device 70 causes toner to adhere to an electrostatic latent image on the photoconductor drum 61 to develop the electrostatic latent image using the toner. This forms a toner image serving as a visible image on the surface of the photoconductor drum 61. As shown in FIG. 12, the developing device 70 includes a housing 71 (an example of a housing), a stirring member 72, a supply roller 73 (an example of a rotating member), and the developing roller 74 (an example of the rotating member). The stirring member 72, the supply roller 73, and the developing roller 74 are rotatably supported by the housing 71.

The housing 71 is a molded part formed from, for example, synthetic resin. As shown in FIGS. 9 to 11, the housing 71 is elongated in the left-right direction 9 (longitudinal direction). The housing 71 stores therein developer that contains toner. That is, the housing 71 functions as a developer container (also referred to as "toner container") as well as the housing that supports the developing roller 74 and the like.

As shown in FIG. 12, the stirring member 72 is disposed in a front part inside the housing 71. The stirring member 72 is rotatably supported by a pair of support frames 711 (see FIGS. 9 to 11) each disposed on either side of the housing 71 in the left-right direction 9 (axial direction). It is noted that the pair of support frames 711 (an example of a pair of support members) each constitute a side face on either side of the housing 71 in the left-right direction 9.

Figure 14:
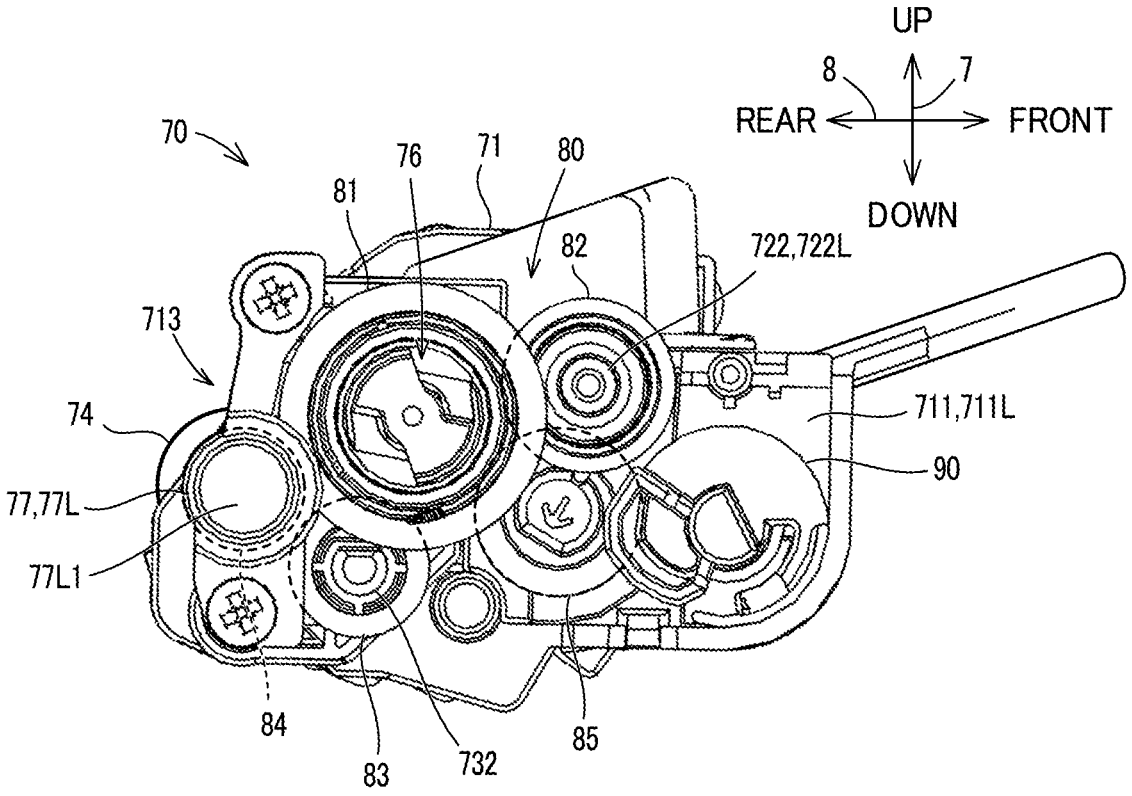
FIG. 14 is a left side view of the developing device according to the embodiment of the present disclosure with its side cover removed.

A support shaft 722 (see FIG. 14) rotatably supported by the corresponding support frame 711 is disposed on either end of a shaft member 721 of the stirring member 72 in the width direction. The left support shaft 722L of the stirring member 72 is rotatably supported by a bearing bore (not shown) formed in the left support frame 711L. As shown in FIG. 14, the support shaft 722L passes through the bearing bore and protrudes to the outside of the support frame 711L. A transmission gear 82 (described later) is attached to the support shaft 722L.

As shown in FIG. 12, the shaft member 721 of the stirring member 72 is provided with a film-like paddle portion 723 perpendicular to the shaft member 721. When a rotational driving force is input to the stirring member 72, the stirring member 72 rotates, and thereby the developer stored in the housing 71 is stirred by the paddle portion 723. As the developer is stirred by the stirring member 72, the toner contained in the developer is electrically charged.

As shown in FIG. 9, a side cover 75 is attached to the left support frame 711L of the housing 71.

Figure 13:
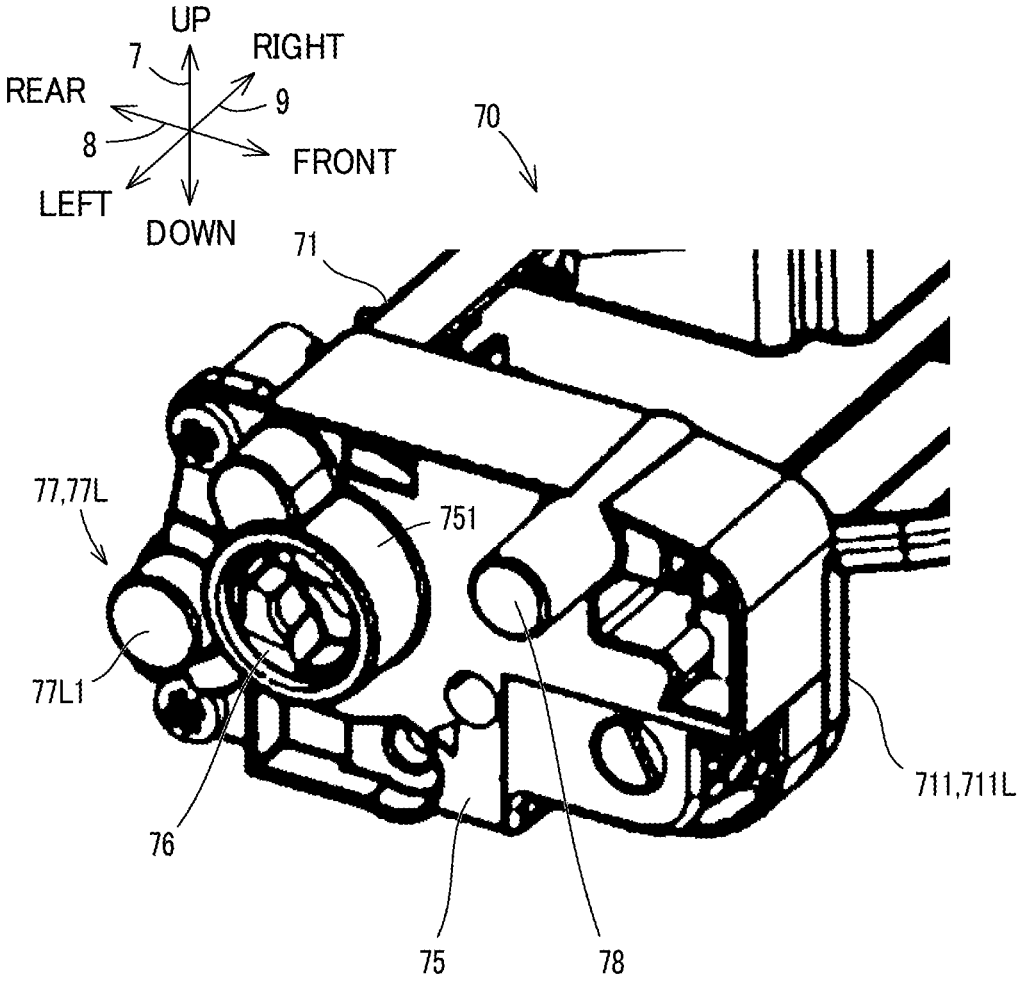
FIG. 13 is a partial enlarged view of a left part of the developing device according to the embodiment of the present disclosure.

FIG. 13 is a partial enlarged view of a left part of the developing device 70. FIG. 14 is a left side view of the developing device 70 from which the side cover 75 is removed.

As shown in FIG. 13, the side cover 75 is attached to the support frame 711L to cover the left face of the support frame 711L. As shown in FIG. 14, a transmission mechanism 80 composed of a plurality of gears 81 to 85 is disposed inside the side cover 75, that is, in a gap between the side cover 75 and the support frame 711L. The gears 81 to 85 constituting the transmission mechanism 80 are rotatably supported by the support frame 711L.

As shown in FIG. 14, the transmission mechanism 80 includes an input portion 76 to which a driving force is input from the outside. That is, the input portion 76 is provided for the support frame 711L. The input portion 76 is, for example, a shat coupling. The side cover 75 includes a cylindrical tubular portion 751 (see FIG. 13) through which the input portion 76 passes to be exposed to the outside. As shown in FIG. 13, when the side cover 75 is attached to the support frame 711L, the input portion 76 is exposed to the outside through the tubular portion 751.

When the developing device 70 is installed in the apparatus body 11, a driving-force output portion (not shown) provided for the apparatus body 11 is connected to the input portion 76. This enables the rotational driving force of a driving source such as a motor to be input to the input portion 76 through the driving-force output portion. The input portion 76 includes an input gear 81 (see FIG. 14) disposed to be coaxial to the input portion 76. That is, the transmission mechanism 80 includes the input gear 81. When the rotational driving force is input to the input portion 76, the rotational driving force is transmitted from the input gear 81 to the other transmission gears 82 to 85 constituting the transmission mechanism 80.

As shown in FIG. 14, the transmission mechanism 80 includes the plurality of transmission gears 82 to 85. The transmission gears 82 to 85 are disposed on the outer surface of the support frame 711L. The transmission gear 82 is attached to the support shaft 722L of the stirring member 72 to transmit the rotational driving force to the stirring member 72. The transmission gear 83 is attached to an end of a rotation shaft 732 (an example of a second support shaft) of the supply roller 73 to transmit the rotational driving force to the supply roller 73. The transmission gear 84 is attached to an end of a rotation shaft 742 (see FIG. 12) of the developing roller 74 to transmit the rotational driving force to the developing roller 74. In addition, the transmission gear 85 is rotatably supported by the support frame 711L while meshing with the transmission gear 82. The transmission gear 85 transmits the rotational driving force to a rotating member 90 disposed on the support frame 711L.

When the rotational driving force is input to the input portion 76 and transmitted from the input gear 81 to the other transmission gears 82 to 85 constituting the transmission mechanism 80, the rotational driving force is transmitted to the stirring member 72, the supply roller 73, the developing roller 74, and the rotating member 90, and thereby the stirring member 72, the supply roller 73, the developing roller 74, and the rotating member 90 rotate.

As shown in FIG. 12, the supply roller 73 is disposed in front (away in a direction opposite to that along which the developing device 70 is inserted) of the developing roller 74 and behind the stirring member 72. The supply roller 73 is a roller member that rotates while carrying toner contained in the developer on the outer peripheral surface thereof. The supply roller 73 is rotatably supported by the pair of support frames 711. The supply roller 73 rotates to convey the developer stored in the housing 71 to a position facing the developing roller 74 by carrying the developer on the outer peripheral surface thereof.

The supply roller 73 includes a cylindrical roller body 731 composed of an elastic member having electrical conductivity and the rotation shaft 732 having electrical conductivity and disposed in the center of the roller body 731. For example, the roller body 731 is composed of an elastic member such as urethane in which carbon is moderately dispersed. The rotation shaft 732 is a metal shaft having electrical conductivity. The ends of the rotation shaft 732 are rotatably supported by bearing bores (not shown) formed in the pair of support frames 711. A predetermined bias (hereinafter referred to as "supply bias") is applied to the supply roller 73 so that the supply roller 73 can carry toner on the outer peripheral surface thereof and that the toner can move from the supply roller 73 to the developing roller 74.

In the present embodiment, the supply bias is applied from a supply terminal 117 (see FIG. 8) provided for the apparatus body 11 to the rotation shaft 732 of the supply roller 73 while the developing device 70 is installed in the apparatus body 11. Specifically, the supply terminal 117 is disposed at a position where the supply terminal 117 is in contact with the guide portion 791 (described later; see FIGS. 15 and 16) when the developing device 70 is in an installed state. When the developing device 70 is installed in the apparatus body 11, the guide portion 791 comes into contact with the supply terminal 117, and thereby the supply bias is applied from the supply terminal 117 to the rotation shaft 732 through the guide portion 791, a guide member 79, and a connection portion 792.

The developing roller 74 is disposed in a rear part inside the housing 71. The developing roller 74 is a roller member that rotates while carrying the toner contained in the developer on the outer peripheral surface thereof. The developing roller 74 is rotatably supported by the pair of support frames 711. The housing 71 has an opening 713 in the rear face thereof. The developing roller 74 is exposed to the outside through the opening 713. When the developing device 70 is installed in the apparatus body 11, the developing roller 74 faces the photoconductor drum 61 with a predetermined gap therebetween.

The developing roller 74 includes a cylindrical roller body 741 composed of an elastic member having electrical conductivity and the rotation shaft 742 (an example of a first support shaft) having electrical conductivity and disposed in the center of the roller body 741. For example, the roller body 741 is composed of an elastic member such as urethane in which carbon is moderately dispersed. The rotation shaft 742 is a metal shaft having electrical conductivity. The ends of the rotation shaft 742 are rotatably supported by the bearing portions 77 (77L, 77R) provided for the pair of support frames 711 (see FIG. 11). A predetermined bias (hereinafter referred to as "developing bias") is applied to the developing roller 74 so that the toner can move from the supply roller 73 to the developing roller 74. The potential difference between the developing bias and the supply bias causes the electrically charged toner to be supplied from the supply roller 73 to the developing roller 74.

In the present embodiment, the developing bias is applied from a supply terminal 116 (see FIG. 8) provided for the apparatus body 11 to the rotation shaft 742 of the developing roller 74 while the developing device 70 is installed in the apparatus body 11. Specifically, the supply terminal 116 is disposed at a position where the supply terminal 116 is in contact with the bearing portion 77R (described later; see FIG. 15) when the developing device 70 is in the installed state. When the developing device 70 is installed in the apparatus body 11, a guide portion 77R2 (see FIG. 15) of the bearing portion 77R comes into contact with the supply terminal 116, and thereby the developing bias is applied from the supply terminal 116 to the rotation shaft 742 through the guide portion 77R2.

As shown in FIG. 14, the bearing portion 77L (an example of a first bearing portion) is provided for the support frame 711L. The bearing portion 77L is integral to the support frame 711L and includes a cylindrical guide portion 77L1 (an example of a first guide portion) protruding outward from the outer surface of the support frame 711L. The bearing portion 77L has therein a bearing bore in which the left shaft end of the rotation shaft 742 is fitted. Thus, the shaft end is rotatably supported. In the present embodiment, the guide portion 77L1 of the bearing portion 77L and the guide portion 77R2 of the bearing portion 77R (described later) also function as guide members for guiding the developing device 70 to the installation positions P11 defined on the drum unit 60 during the installation of the developing device 70 in the apparatus body 11.

As shown in FIG. 13, the side cover 75 is provided with the guide portion 78 integral to the side cover 75. The guide portion 78 is disposed in front (away in the direction opposite to that along which the developing device 70 is inserted) of (the guide portion 77L1 of) the bearing portion 77L at a predetermined distance. The guide portion 78 is a cylindrical member protruding outward from the outer surface of the side cover 75. In the present embodiment, the guide portion 78 and the guide portion 791 of the guide member 79 (described later) guide the front end part of the developing device 70 downward during the installation of the developing device 70 in the apparatus body 11.

Figure 15:
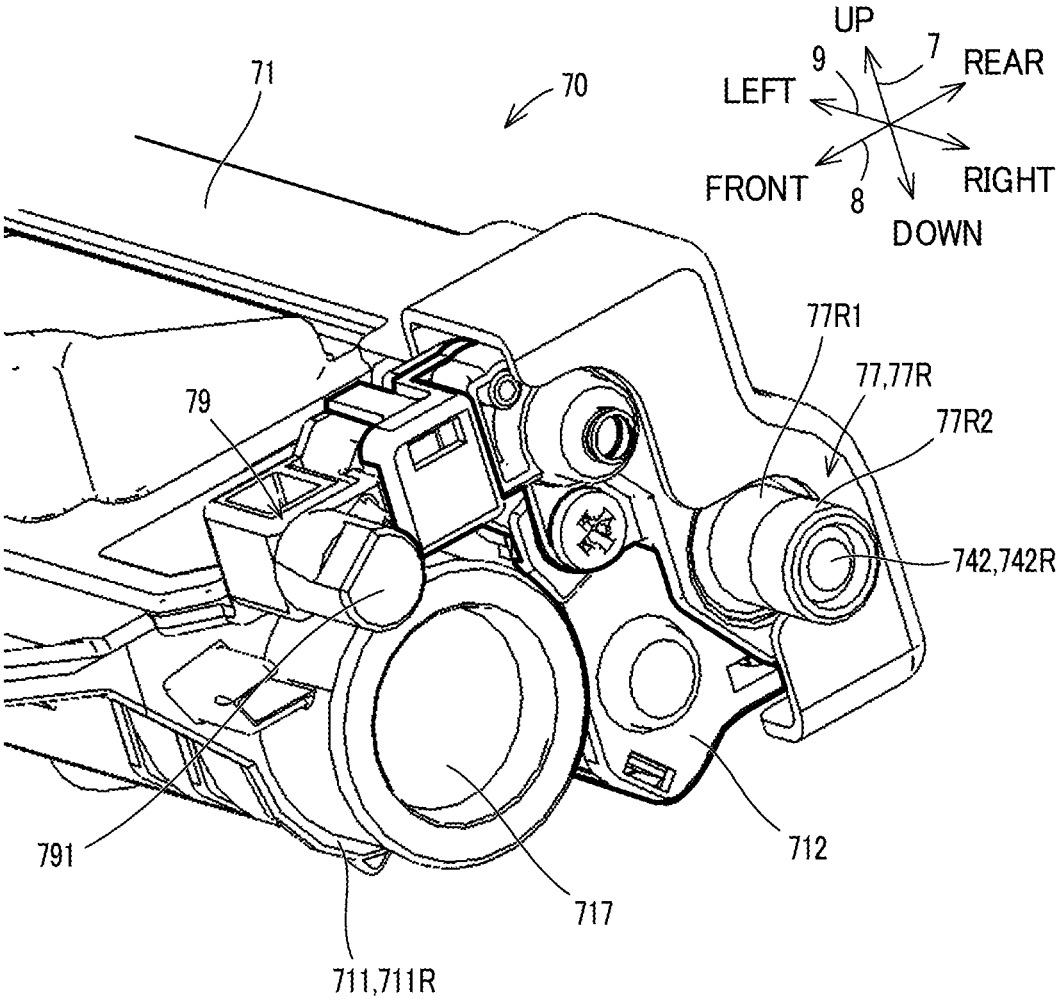
FIG. 15 is a partial enlarged perspective view of a right part of the developing device according to the embodiment of the present disclosure.

FIG. 15 is an enlarged perspective view of a right part of the developing device 70.

As shown in FIG. 15, the bearing portion 77R (an example of the first bearing portion) is provided for the support frame 711R. The bearing portion 77R includes a cylindrical portion 77R1 integral to the support frame 711R and the guide portion 77R2 (an example of the first guide portion) to be guided during the installation of the developing device 70 in the apparatus body 11. The cylindrical portion 77R1 protrudes outward from the outer surface of the support frame 711R. The cylindrical portion 77R1 has therein a hole in which the right shaft end 742R of the rotation shaft 742 is fitted. Thus, the shaft end 742R is rotatably supported.

When the rotation shaft 742 is placed through the cylindrical portion 77R1, the shaft end 742R passes through the cylindrical portion 77R1 and is exposed to the outside. The tubular guide portion 77R2 is attached to the exposed portion. The guide portion 77R2 is composed of, for example, a conductive member. In the present embodiment, the guide portion 77R2 guides the developing device 70 to the installation position P11 defined on the drum unit 60 during the installation of the developing device 70 in the apparatus body 11.

As shown in FIG. 15, the guide portion 791 is provided for the support frame 711R. Specifically, the guide portion 791 is integral to the guide member 79 composed of a conductive member, and the guide member 79 is fixed to the support frame 711R. It is noted that the guide portion 791 is an example of a second guide portion.

Figure 16:
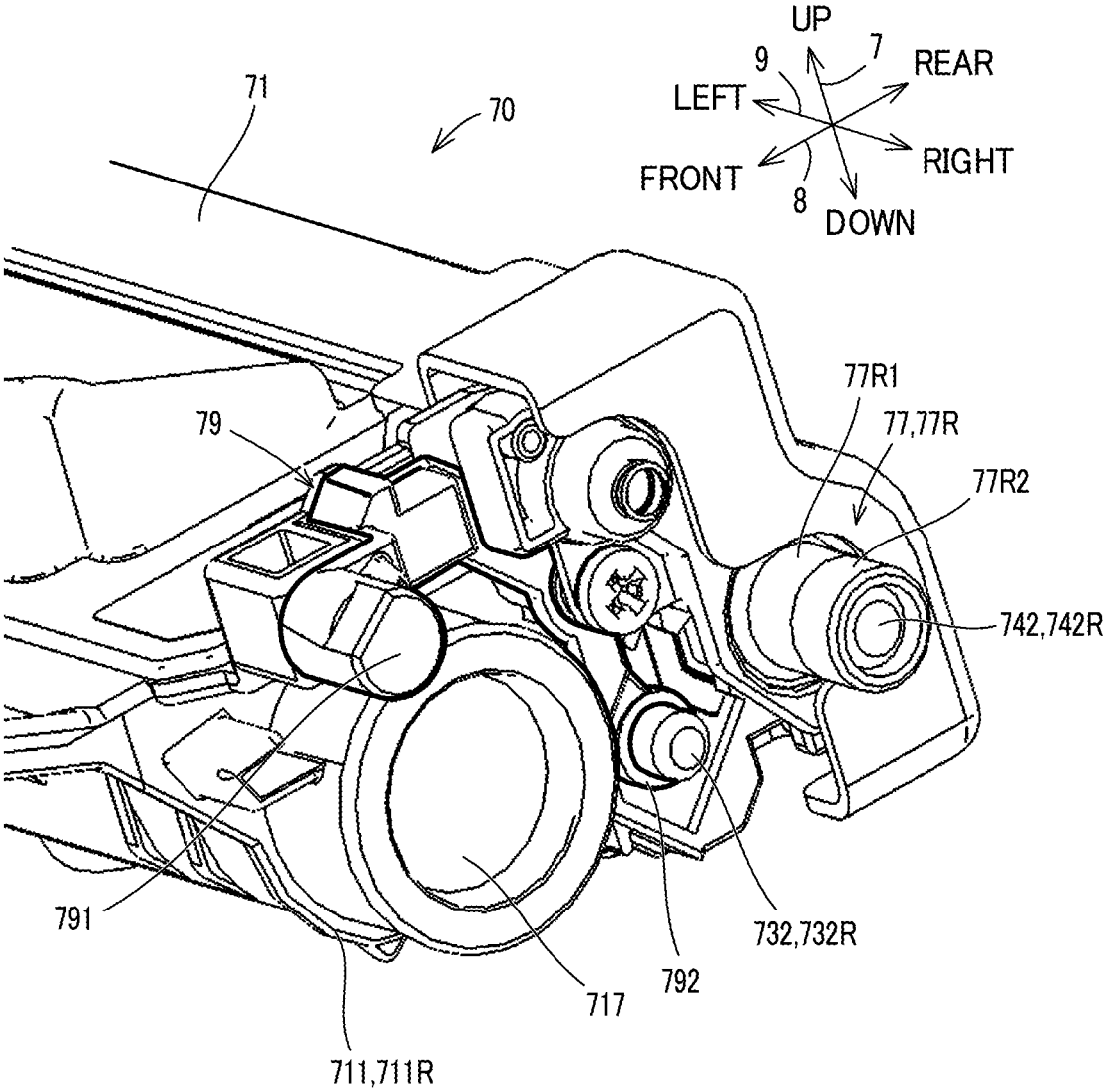
FIG. 16 is a perspective view of the developing device according to the embodiment of the present disclosure with its shaft cover removed from the right part.

FIG. 16 is a perspective view of the developing device 70, from the right part of which a shaft cover 712 (see FIG. 15) is being removed. As shown in FIG. 16, the support frame 711R has therein a bearing bore that supports the right shaft end 732R of the rotation shaft 732 of the supply roller 73. The shaft end 732R is placed through the bearing bore. The shaft cover 712 (see FIG. 15) is attached to the outer surface of the support frame 711R to cover the shaft end 732R. The shaft cover 712 is a member enclosed by bold solid lines in FIG. 15.

As shown in FIG. 16, the guide member 79 is attached to the outer surface of the support frame 711R. The guide member 79 is a member enclosed by bold solid lines in FIG. 16. The guide member 79 is composed of a member having electrical conductivity and includes the guide portion 791 and the connection portion 792. The connection portion 792 connects the support frame 711R to the shaft end 732R protruding outward. Thus, the rotation shaft 732 having electrical conductivity and the guide member 79 having electrical conductivity are connected also electrically.

The guide portion 791 is disposed in front of the bearing portion 77R at a predetermined distance. The guide portion 791 is a cylindrical member protruding outward from the outer surface of the support frame 711R. In the present embodiment, the guide portion 791 guides the front end part of the developing device 70 downward during the installation of the developing device 70 in the apparatus body 11.

In addition, as shown in FIGS. 15 and 16, the support frame 711R is provided with a cap member (cover member) 717 that closes a toner fill port formed in the support frame 711R. The toner fill port communicates with the inside of the housing 71 so that toner is supplied to the inside through the toner fill port.

A known developing device is provided with guide members on side parts of the developing device. However, the spaces on the side parts are insufficient to accommodate other members such as bearing portions and power receiving members in addition to the guide members. As a result, the housing of the developing device needs to be enlarged, preventing a reduction in the size of the developing device.

In contrast, as described above, the developing device 70 according to the present embodiment includes the bearing portions 77 (77L, 77R) provided for the pair of support frames 711. Accordingly, when the developing device 70 is inserted into the apparatus body 11 in which the drum unit 60 is installed, the guide portion 77L1 of the bearing portion 77L and the guide portion 77R2 of the bearing portion 77R provided for the developing device 70 are guided to the installation positions P11 (see FIG. 8) along the guide surfaces 112A of the apparatus body 11.

Specifically, the guide portion 77L1 and the guide portion 77R2 are inserted into the guide grooves 111 from the insertion openings 113 and reach the first inflection points P1 on the guide grooves 111. The guide portion 77L1 and the guide portion 77R2 then enter the guide grooves 112 from the upper end openings 114. Subsequently, the guide portion 77L1 and the guide portion 77R2 are guided to the installation positions P11 along the guide surfaces 112A of the guide grooves 112. After the guide portion 77L1 and the guide portion 77R2 are guided by the guide surfaces 112A and enter the guide grooves 646, the guide portion 77L1 and the guide portion 77R2 are guided to the installation positions P11 by the guide grooves 646. The guide portion 77L1 and the guide portion 77R2 guided to the installation positions P11 are restrained at the installation positions P11 by the stoppers 647.

During the installation of the developing device 70 in the apparatus body 11, the guide portions 78 and 791 that have entered the guide grooves 112 are guided approximately downward along the guide surfaces 1126 of the guide grooves 112.

Thus, the developing device 70 is positioned on the drum unit 60 and locked to the drum unit 60 by the locking mechanism (not shown).

In addition, in the developing device 70 according to the present embodiment, the guide portion 77L1 provided for the bearing portion 77L and the guide portion 77R2 provided for the shaft end 742R are used as members to be guided during the installation of the developing device 70. In other words, the bearing portions 77L and 77R also function as guide members when the developing device 70 is installed in and removed from the apparatus body 11. This reduces or eliminates members disposed on the side parts of the developing device 70, resulting in a reduction in the size of the housing 71 of the developing device 70.

In the present embodiment, when the developing device 70 is in the installed state, the guide portion 791 is in contact with the supply terminal 117, and the supply bias is applied from the supply terminal 117 to the rotation shaft 732 through the guide portion 791, the guide member 79, and the connection portion 792. In addition, the guide portion 77R2 of the bearing portion 77R is in contact with the supply terminal 116, and the developing bias is applied from the supply terminal 116 to the rotation shaft 742 through the guide portion 77R2. That is, the guide member 79 also functions as a power receiving terminal (power receiving portion) for receiving the supply bias, and the bearing portion 77R also functions as a power receiving terminal (power receiving portion) for receiving the developing bias. This eliminates the need for power receiving terminals to be disposed on the side parts of the developing device 70, thereby further reducing or eliminating members disposed on the side parts. As a result, the size of the housing 71 of the developing device 70 can be further reduced.

Figure 17:
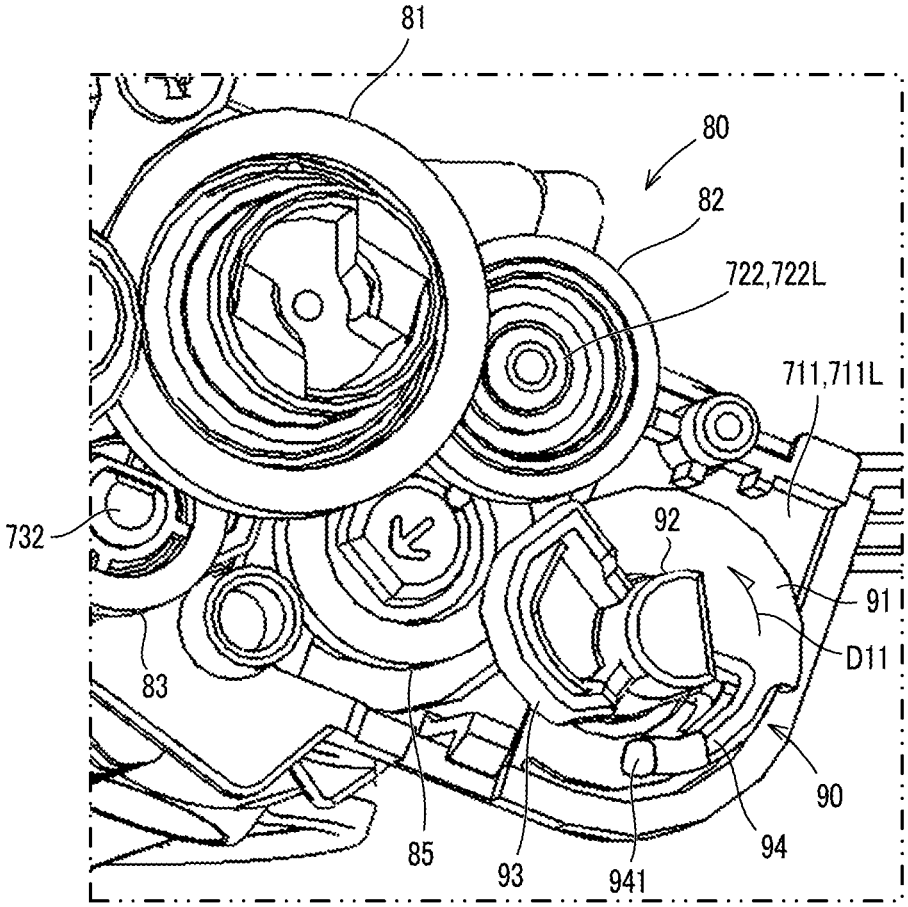
FIG. 17 is a partial enlarged view of the left part of the developing device according to the embodiment of the present disclosure with its side cover removed.

FIG. 17 is an enlarged perspective view showing the details of the vicinity of the rotating member 90. As shown in FIG. 17, the housing 71 of the developing device 70 is provided with the rotating member 90 (an example of a displaceable member). Specifically, as described above, the rotating member 90 is supported by the outer surface of the support frame 711L. The rotating member 90 is a displaceable member that can be displaced between an initial position (position shown in FIGS. 14 and 17) at which the rotating member 90 is not detected by a detection switch 120 (described later; see FIG. 23) and a detection position (position shown in FIG. 20) at which the rotating member 90 is detected by the detection switch 120.

In the present embodiment, the rotating member 90 is rotatably supported by a support shaft 718 (see FIG. 21) extending straight from the support frame 711L. Accordingly, the rotating member 90 can rotate from the initial position to the detection position in a rotation direction D11 (an example of a first rotation direction) shown in FIG. 17. Here, the rotation direction D11 is a direction of rotation from the initial position toward the detection position.

Figure 18:
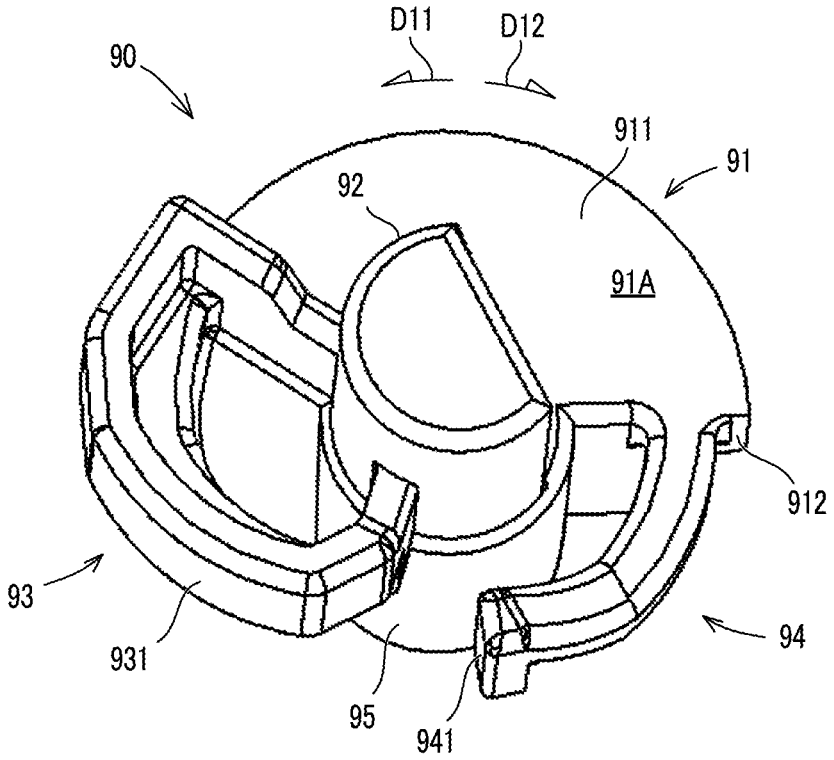
FIG. 18 is a perspective view of a rotating member disposed in the left part of the developing device.
Figure 19:
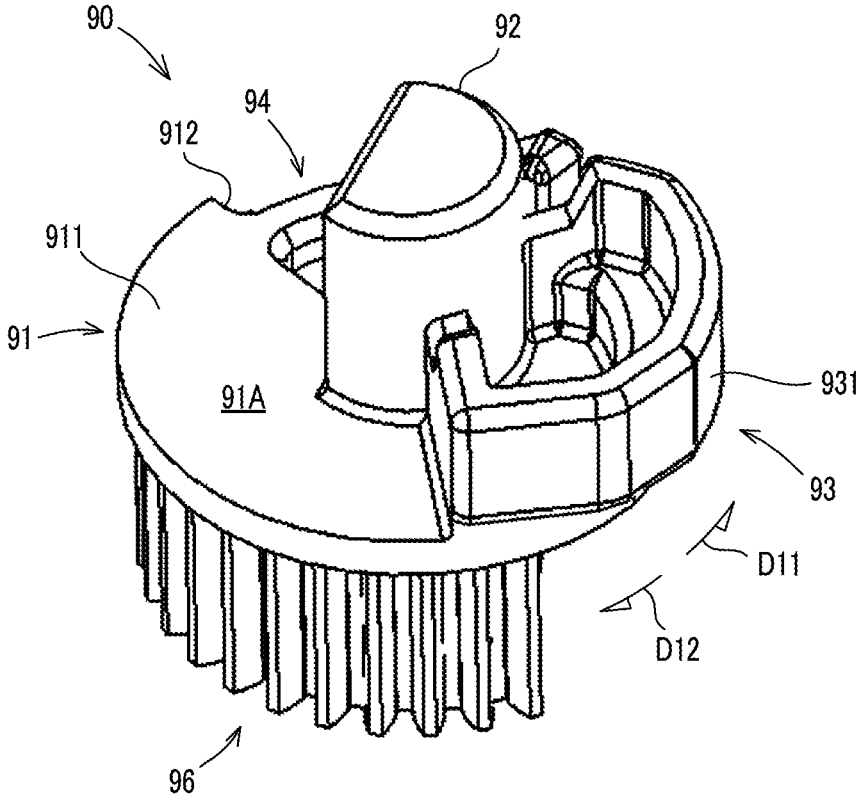
FIG. 19 is a perspective view of the rotating member disposed in the left part of the developing device.

FIGS. 18 and 19 are perspective views of the rotating member 90. As shown in FIGS. 18 and 19, the rotating member 90 includes a rotating body 91 rotatably supported by the support frame 711L, a protruding portion 92 protruding perpendicularly from a first face 91A of the rotating body 91, a detection target portion 93 provided for the protruding portion 92, an elastic portion 94 provided for the rotating body 91, a support portion 95 disposed on a second face, which is the face opposite the first face 91A, of the rotating body 91, and a gear portion 96 (see FIG. 19) disposed on the second face of the rotating body 91. The rotating member 90 is a molded part composed of the above-described components in an integrated manner and formed from synthetic resin.

The support portion 95 has a shaft hole in an end away from the protruding portion 92. The support shaft 718 (see FIG. 21) is placed through the shaft hole. The rotating member 90 is rotatably supported by the support shaft 718 by inserting the support shaft 718 into the shaft hole.

The rotating body 91 includes a thin, flat fan-shaped portion 911 having the axis center of the support shaft 718 provided for the support frame 711L as its center. The central angle of the fan-shaped portion 911 is approximately 120 degrees. The protruding portion 92 having a pillar shape is disposed at the central part of the fan-shaped portion 911.

The elastic portion 94 having an arc shape extends from a circumferential end of the fan-shaped portion 911. Specifically, the fan-shaped portion 911 has an end 912 facing a reverse direction D12, and the elastic portion 94 having a curved rod shape protrudes from the end 912 in the reverse direction D12. Here, the reverse direction D12 is a direction opposite the rotation direction D11. The elastic portion 94 is disposed at a predetermined distance from the protruding portion 92. Accordingly, when the elastic portion 94 is subjected to an external force acting from radially outside the rotating member 90 toward the center, the elastic portion 94 is elastically bent toward the protruding portion 92. It is noted that the elastic portion 94 returns to its original position when the external force is removed.

The detection target portion 93 is provided for the protruding portion 92. The detection target portion 93 is detected by the detection switch 120 (see FIG. 23). The detection target portion 93 is disposed on a side opposite the side on which the fan-shaped portion 911 lies and at a position approximately 90 degrees away from the elastic portion 94 in the reverse direction D12. Moreover, the detection target portion 93 is disposed at a position farther outward from the first face 91A than the elastic portion 94. In addition, the detection target portion 93 protrudes radially outward further than the outer peripheral edge of the fan-shaped portion 911 and the elastic portion 94.

In a case where the rotating member 90 is located at the initial position, the detection target portion 93 does not face the detection switch 120. In the present embodiment, in a case where the rotating member 90 is rotated to the detection position in the rotation direction D11, the detection target portion 93 faces the detection switch 120. At this moment, the detection target portion 93 abuts on a push portion 121 of the detection switch 120 to push the push portion 121 in. This activates the detection switch 120, and a detection signal is input to a control portion 100 (described later; see FIG. 24).

The detection target portion 93 also functions as a cam member that pushes the push portion 121 of the detection switch 120 (see FIG. 22) in to activate the detection switch 120. To achieve this, the detection target portion 93 includes an arc-shaped cam portion 931 that moves the push portion 121 in a push-in direction.

As shown in FIG. 19, the gear portion 96 having an arc shape is disposed on the second face of the fan-shaped portion 911. The gear portion 96 has a shape corresponding to the arc part of the fan-shaped portion 911 and is formed along the outer peripheral edge of the fan-shaped portion 911. The gear portion 96 is meshable with the transmission gear 85 constituting the transmission mechanism 80. In the present embodiment, the gear portion 96 meshes with the transmission gear 85 when the rotating member 90 is located at the initial position. The gear portion 96 meshes with the transmission gear 85 until the rotating member 90 rotates in the rotation direction D11 to reach the detection position. When the rotating member 90 reaches or passes through the detection position, the gear portion 96 is separated from the transmission gear 85; that is, the gear portion 96 and the transmission gear 85 are disengaged from each other.

Figure 20:
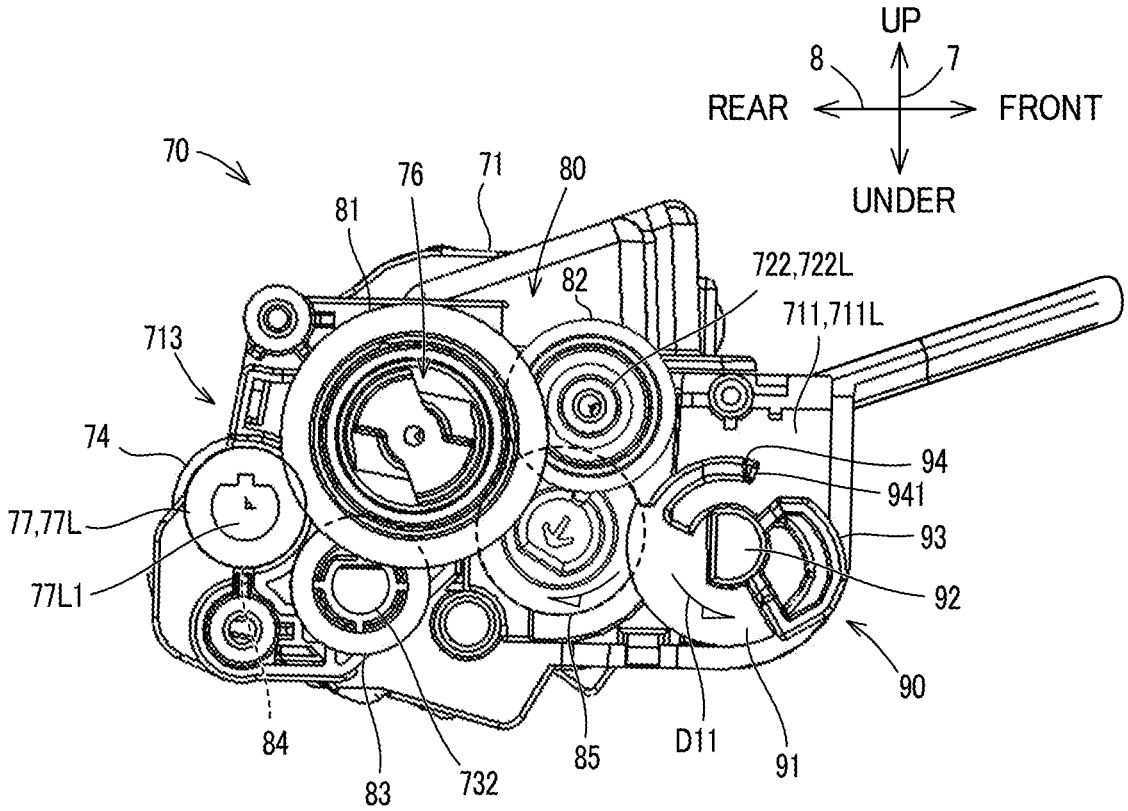
FIG. 20 is a left side view of the developing device according to the embodiment of the present disclosure with its side cover removed.

FIG. 20 shows a state where the rotating member 90 has reached the detection position after rotating from the initial position in the rotation direction D11. When the rotational driving force of the driving source such as the motor is input to the input portion 76 and transmitted from the input gear 81 to the gear portion 96 through the transmission gear 82 and the transmission gear 85, the rotating member 90 rotates in the rotation direction D11 to move from the initial position to the detection position. When the rotating member 90 reaches the detection position, the transmission gear 85 stops transmitting the rotational driving force, and the rotating member 90 stops at the detection position.

Figure 21:
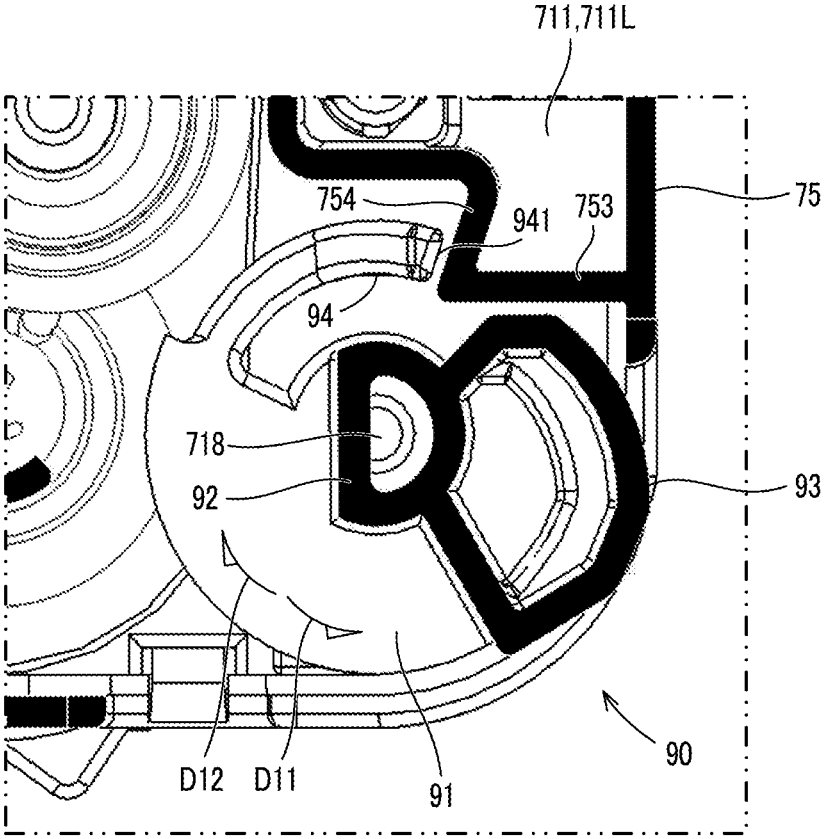
FIG. 21 is a cross-sectional view taken along a cutting plane passing through a detection target portion of the rotating member in the left part of the developing device.

FIG. 21 is a cross-sectional view taken along a cutting plane passing through the detection target portion 93 with the side cover 75 attached to the left support frame 711L of the housing 71. FIG. 21 shows a state where the rotating member 90 is located at the detection position.

As shown in FIG. 21, the developing device 70 includes a first restricting portion 753 and a second restricting portion 754. Specifically, the first restricting portion 753 and the second restricting portion 754 are integral to the inner surface of the side cover 75. Both the first restricting portion 753 and the second restricting portion 754 restrict the rotation of the rotating member 90 when the rotating member 90 is located at the detection position.

The first restricting portion 753 of the side cover 75 attached to the support frame 711L abuts on the detection target portion 93 and restricts the rotation of the rotating member 90 from the detection position in the rotation direction D11. Accordingly, the rotating member 90 in the developing device 70 detached from the apparatus body 11 cannot be rotated in the rotation direction D11 manually while the side cover 75 is attached.

The second restricting portion 754 of the side cover 75 attached to the support frame 711L abuts on a distal end portion 941 of the elastic portion 94 and restricts the rotation of the rotating member 90 from the detection position in the reverse direction D12 (an example of a second rotation direction).

During the rotation of the rotating member 90 from the initial position to the detection position, the elastic portion 94 comes into contact with the first restricting portion 753. As the rotational driving force is further applied to the rotating member 90 in the rotation direction D11, the elastic portion 94 is pushed toward the center of the rotating member 90 by the first restricting portion 753. The rotating member 90 rotates while the elastic portion 94 is bent toward the center. Thus, the elastic portion 94 passes over the first restricting portion 753 and reaches the detection position shown in FIG. 21. After the elastic portion 94 passes over the first restricting portion 753, the pressure by the first restricting portion 753 is removed, and the elastic portion 94 returns to its original state.

When the rotating member 90 in this state is rotated in the reverse direction D12, the distal end portion 941 of the elastic portion 94 abuts on the second restricting portion 754. This prevents the rotating member 90 from rotating from the detection position in the reverse direction D12. Accordingly, the rotating member 90 in the developing device 70 detached from the apparatus body 11 cannot be rotated in the reverse direction D12 manually while the side cover 75 is attached.

Figure 22:
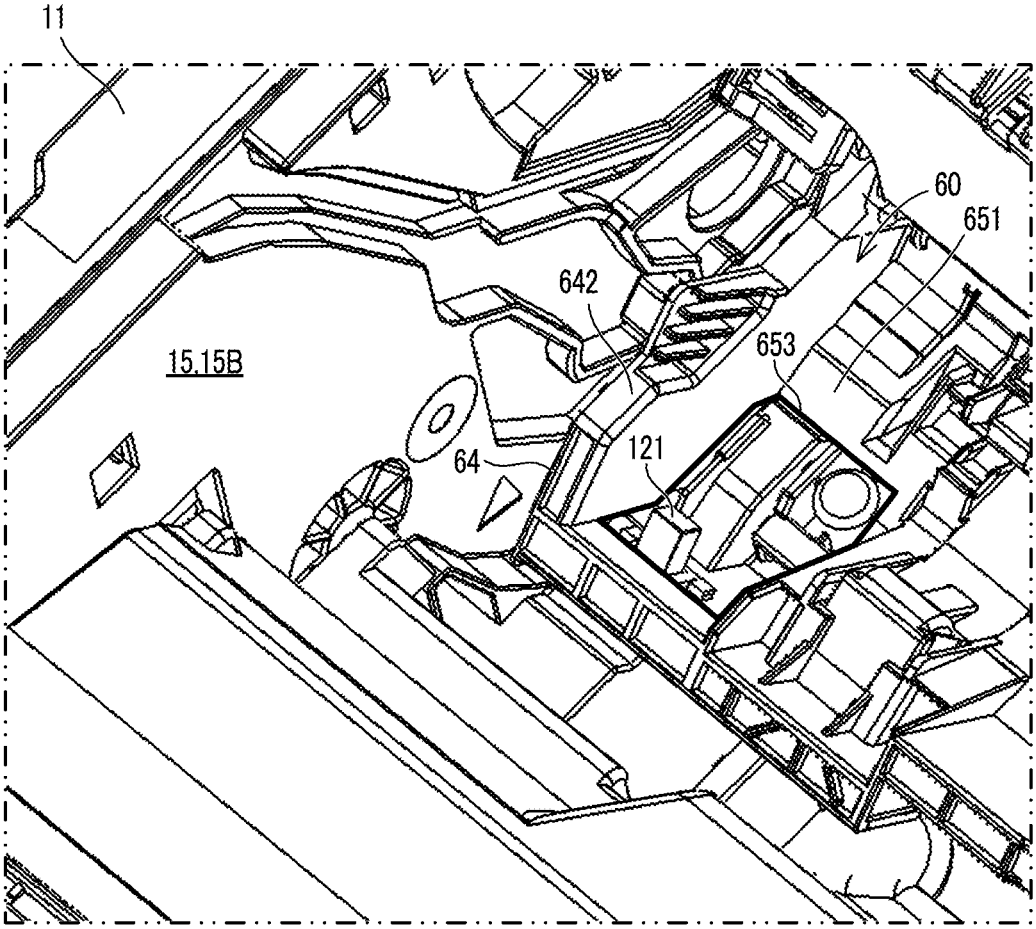
FIG. 22 shows a detection switch provided for the image forming apparatus according to the embodiment of the present disclosure.
Figure 23:
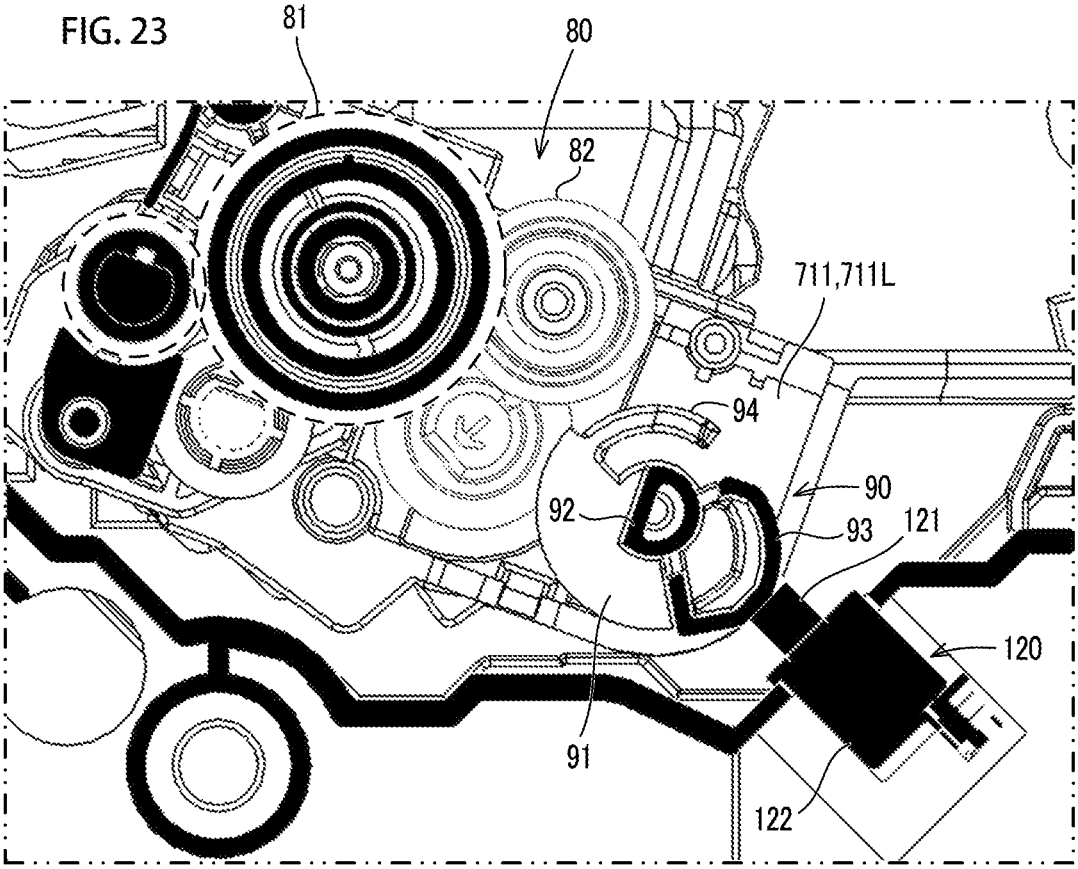
FIG. 23 is a cross-sectional view of the vicinity of the rotating member when the developing device is installed in the image forming apparatus.

FIG. 22 shows the push portion 121 of the detection switch 120 provided for the image forming apparatus 10. FIG. 23 is a cross-sectional view of the vicinity of the rotating member 90 when the developing device 70 is installed in the apparatus body 11 of the image forming apparatus 10. FIG. 23 shows a state where the detection target portion 93 of the rotating member 90 pushes the push portion 121 of the detection switch 120 in.

As shown in FIG. 23, the detection switch 120 (an example of a detection portion) is provided for the apparatus body 11. The detection switch 120 is for determining the state of the developing device 70 installed in the image forming apparatus 10. The detection switch 120 is, for example, a limit switch and includes the push portion 121 that activates a built-in contact. The push portion 121 is a movable portion that can move relative to a switch body 122. When the push portion 121 is pushed into the switch body 122 against the elastic force of an elastic member such as a spring disposed inside the switch body 122, the contact is brought into conduction and outputs the detection signal. The detection signal is input to the control portion 100 (described later). It is noted that the detection switch 120 is only an example of a detection portion and that a detection portion composed of, for example, a transmission optical sensor and an actuator is also applicable instead of the detection switch 120.

FIG. 22 shows a state where the drum unit 60 is installed in the apparatus body 11 without the developing device 70 installed in the apparatus body 11. As shown in FIG. 22, an opening 653 is formed in the housing 64 of the drum unit 60. Specifically, the opening 653 having a rectangular shape is formed in the second base frame 651 in the developing-device support portion 65 of the housing 64. When the drum unit 60 is installed in the apparatus body 11, the push portion 121 of the detection switch 120 is placed through the opening 653 to protrude upward from the second base frame 651. As a result, installation of the developing device 70 on the drum unit 60 enables the detection target portion 93 of the rotating member 90 to push the push portion 121.

In the present embodiment, even when the developing device 70 is installed on the drum unit 60 in the apparatus body 11, the detection switch 120 is not activated in the case where the rotating member 90 is located at the initial position. However, in the case where the rotating member 90 is located at the detection position, the detection switch 120 is activated by the detection target portion 93.

Figure 24:
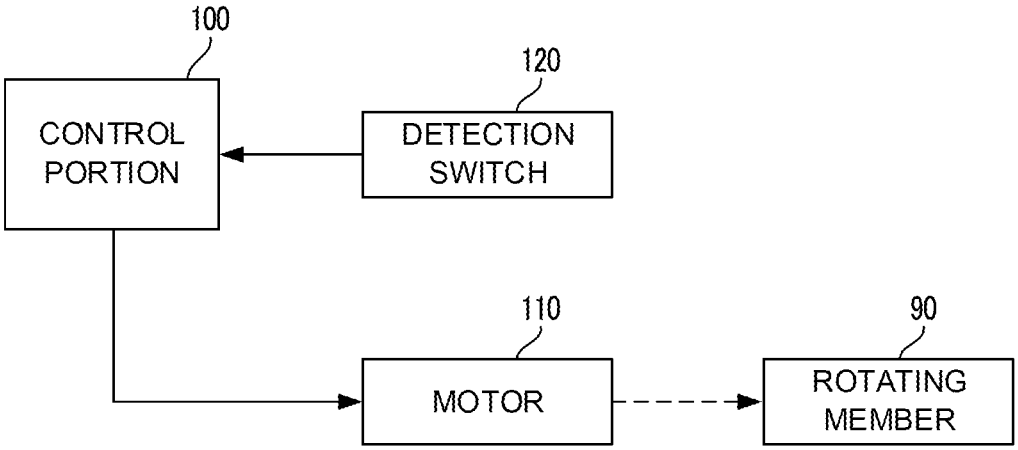
FIG. 24 is a block diagram showing the connection relationships among a control portion, a motor, and the detection switch.

As shown in FIG. 24, the image forming apparatus 10 further includes the control portion 100 and a motor 110. Here, FIG. 24 is a block diagram showing the connection relationships among the control portion 100, the motor 110, and the detection switch 120.

The control portion 100 controls the operation of components such as the image forming unit 50 provided for the image forming apparatus 10. The control portion 100 includes control devices such as a CPU, a ROM, and a RAM. The CPU is a processor that executes various types of calculation processes. The ROM is a nonvolatile storage medium that stores control programs causing the CPU to execute the various types of calculation processes. The RAM is a volatile or nonvolatile storage medium that stores various types of information. The control portion 100 may be implemented by, for example, an IC such as an ASIC.

The motor 110 is a driving source that supplies the rotational driving force input to the input portion 76 of the developing device 70. The control portion 100 is connected to the motor 110 and controls drive of the motor 110 by outputting a drive signal to the motor 110. The motor 110 is driven when, for example, the developing device 70 performs a development operation.

Usually, when the developing device 70 is replaced, a new, unused developing device 70 is installed in the apparatus body 11 of the image forming apparatus 10 after the used developing device 70 is removed from the image forming apparatus 10. However, the used developing device 70 may be accidentally installed in the apparatus body 11. In addition, the developing device 70 that has deteriorated over time and is past its useful life may be refilled with toner and installed in the image forming apparatus.

The image forming apparatus 10 according to the present embodiment can determine whether the installed developing device 70 is a new, unused developing device 70 or a used developing device 70 that has been used before. Specifically, the control portion 100 performs a process (hereinafter referred to as "condition determination process") of determining whether the developing device 70 installed in the apparatus body 11 is a new, unused developing device 70 or a used developing device 70 that has been used before on the basis of the detection signal (result of detection) from the detection switch 120.

In order for the control portion 100 to perform the condition determination process, the rotating member 90 in a new, unused developing device 70 is located at the initial position.

Figure 25A:
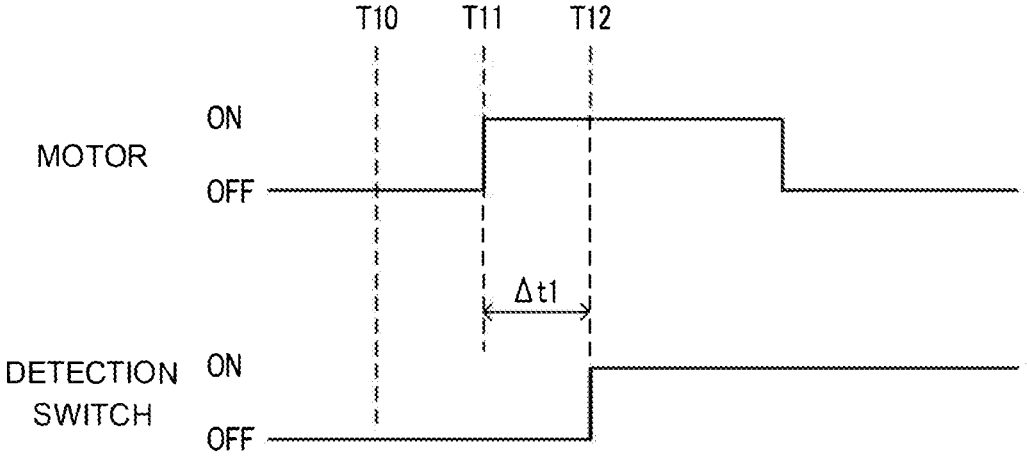
FIG. 25A is a timing chart showing timing of driving the motor and timing of detection by the detection switch in a case where an unused developing device is installed in the apparatus body.
Figure 25B:
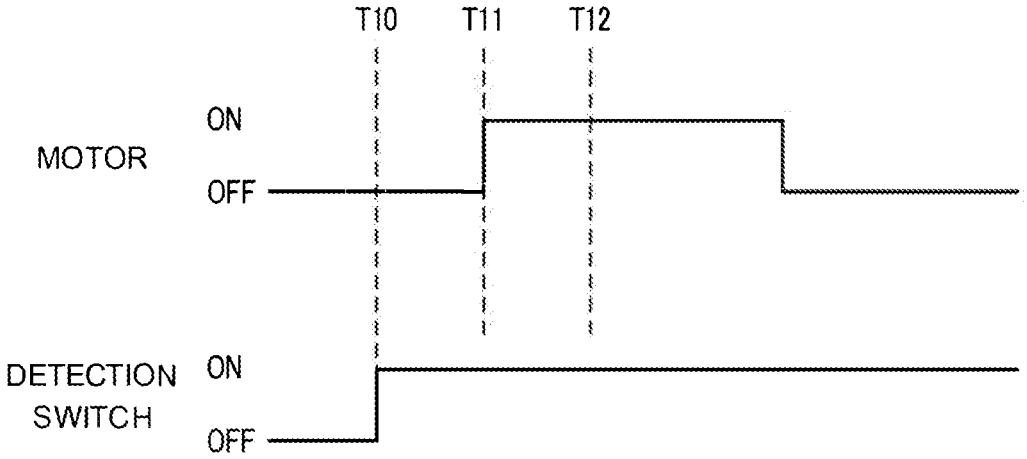
FIG. 25B is a timing chart showing timing of driving the motor and timing of detection by the detection switch in a case where a used developing device is installed in the apparatus body.

The following describes the condition determination process by the control portion 100 using timing charts in FIGS. 25A and 25B. Here, FIG. 25A is a timing chart in a case where an unused developing device 70 is installed in the apparatus body 11. In contrast, FIG. 25B is a timing chart in a case where a used developing device 70 that has been installed before is installed in the apparatus body 11.

As shown in FIG. 25A, for example, in the case the unused developing device 70 is installed on the drum unit 60 inside the apparatus body 11 at a time point T10, the rotating member 90 of the developing device 70 is located at the initial position, and thus the detection target portion 93 of the rotating member 90 does not push the detection switch 120. Accordingly, the detection switch 120 is not activated and maintained in an OFF state. Subsequently, the control portion 100 drives the motor 110 to rotate in a predetermined rotation direction at a time point T11. In this case, the control portion 100 drives the motor 110 until at least the rotating member 90 reaches the detection position. After Δt1 has passed since the start of the motor 110, the rotating member 90 has rotated from the initial position to the detection position. When the rotating member 90 reaches the detection position, the push portion 121 of the detection switch 120 is pushed by the detection target portion 93 at a time point T12, and thereby the detection switch 120 is activated. This changes the state of the detection switch 120 from OFF to ON. At this moment, the detection signal is input to the control portion 100 from the detection switch 120.

In the present embodiment, the control portion 100 determines that the installed developing device 70 is a new, unused developing device in a case where the detection target portion 93 of the rotating member 90 is not detected by the detection switch 120, that is, in a case where the detection signal is not input to the control portion 100 at the time point T10, in the timing chart shown in FIG. 25A, of initial installation immediately after the developing device 70 is installed in the apparatus body 11. For example, the control portion 100 displays the determination result in a display portion (not shown) provided for the image forming apparatus 10.

The control portion 100 may determine that the installed developing device 70 is a new, unused developing device in a case where the detection target portion 93 is not detected by the detection switch 120 at the time point T10 of initial installation and subsequently detected by the detection switch 120 at the time point T12 after Δt1 has passed since the motor 110 is driven to move the rotating member 90 from the initial position to the detection position.

Once the motor 110 has started to rotate the rotating member 90 to the detection position after the developing device 70 is installed in the apparatus body 11, the rotating member 90 is maintained at the detection position as described above. Accordingly, the rotating member 90 does not return to the initial position once the motor 110 is driven after the developing device 70 is installed in the apparatus body 11.

In contrast, as shown in FIG. 25B, for example, in the case where the used developing device 70 is installed on the drum unit 60 inside the apparatus body 11 at the time point T10, the rotating member 90 is located at the detection position, and thus the detection target portion 93 pushes and activates the detection switch 120. That is, the push portion 121 of the detection switch 120 is pushed by the detection target portion 93, and thereby the detection switch 120 is activated at the time point T10. This changes the state of the detection switch 120 from OFF to ON. At this moment, the detection signal is input to the control portion 100 from the detection switch 120.

In the present embodiment, the control portion 100 determines that the installed developing device 70 is a used developing device in a case where the detection target portion 93 of the rotating member 90 is detected by the detection switch 120, that is, in a case where the detection signal is input to the control portion 100 at the time point T10, in the timing chart shown in FIG. 25B, of initial installation immediately after the developing device 70 is installed in the apparatus body 11. For example, the control portion 100 displays the determination result in the display portion (not shown) provided for the image forming apparatus 10.

As described above, the image forming apparatus 10 according to the present embodiment can easily and reliably determine whether the developing device 70 installed in the apparatus body 11 is a new, unused developing device 70 or a used developing device 70 that has been used before. In addition, the determination result of the condition determination process by the control portion 100 is displayed in the display portion of the image forming apparatus 10. Thus, users can easily identify the installed developing device as a new developing device or a developing device that has been used before.

In the above-described embodiments, the developing device 70 is installed on the drum unit 60 installed in the image forming apparatus 10. However, the present disclosure is also applicable to a case where the housing 64 of the drum unit 60 is integral to the apparatus body 11 of the image forming apparatus 10.

It is noted that, when a used toner container is replaced, the used toner container may be accidentally installed in the image forming apparatus 10 during replacement. In addition, a used toner container may be refilled with deteriorated toner and installed in the image forming apparatus 10. In the above-described embodiments, the developing device 70 is detachable from the image forming apparatus 10. However, the present disclosure is also applicable to a toner container detachable from the image forming apparatus 10. In this case, the container body of the toner container has a configuration similar to that of the housing 71 of the developing device 70.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a container that can store developer inside the container;

an apparatus body by which the container is detachably supported;

a detection portion, for determining an installed state of the container, provided for the apparatus body;

a control portion configured to determine whether or not the container is an unused container based on a result of detection by the detection portion; and a driving source generating a driving force and provided for the apparatus body, wherein the container includes:

an input portion to which the driving force is input when the container is in the installed state; and a displaceable member that includes a detection target portion to be detected by the detection portion, and can be displaced between an initial position at which the detection target portion is not detected by the detection portion and a detection position at which the detection target portion is detected by the detection portion, when the container is in an initial installation state immediately after the container is installed in the apparatus body, the control portion determines that the container is an unused container in a case where the displaceable member is not detected by the detection portion, and determines that the container is a used container in a case where the displaceable member is detected by the detection portion, the displaceable member is rotatably supported, via a support shaft, by a support member disposed on one side of a longitudinal direction of the container, and is rotated in a first rotation direction from the initial position to the detection position by receiving the driving force that is input to the input portion after the container is installed in the apparatus body, the initial position is a rotational position at which the detection target portion is not detected by the detection portion, the detection position is a rotational position at which the detection target portion is detected by the detection portion, the displaceable member includes:

a fan-shaped portion having an axis center of the support shaft as its center; and an elastic portion of a curved rod shape protruding, in a second rotation direction opposite to the first rotation direction, from an end of the fan-shaped portion facing the second rotation direction, the container further includes a first restricting portion and a second restricting portion, the first restricting portion is configured to abut on the detection target portion to thereby restrict rotation of the displaceable member in the first rotation direction, and the second restricting portion is configured to abut on a distal end portion of the elastic portion after the displaceable member has reached the detection position, to thereby restrict rotation of the displaceable member in the second rotation direction.

2. The image forming apparatus according to claim 1, wherein the control portion determines that the container is an unused container in a case where the displaceable member is not detected by the detection portion when the container is in the initial installation state and subsequently detected by the detection portion when the displaceable member is displaced from the initial position to the detection position.

3. The image forming apparatus according to claim 1, wherein the displaceable member includes a gear portion that receives the driving force only in a section from the initial position to the detection position.

4. The image forming apparatus according to claim 1, wherein the container is a developing device detachable from the apparatus body.

5. The image forming apparatus according to claim 1, wherein the container is a toner container detachable from the apparatus body.

* * * * *